US010988921B1

(12) United States Patent
Garry

(10) Patent No.: US 10,988,921 B1
(45) Date of Patent: Apr. 27, 2021

(54) METHOD AND DEVICES ENABLING RAPID CONSTRUCTION OF BUILDINGS

(71) Applicant: Matthew Garry, Toowoomba (AU)

(72) Inventor: Matthew Garry, Toowoomba (AU)

(73) Assignee: Overflow, Ltd., Weatherford, TX (US)

( * ) Notice: Subject to any disclaimer, the term of this patent is extended or adjusted under 35 U.S.C. 154(b) by 0 days.

(21) Appl. No.: 16/666,159

(22) Filed: Oct. 28, 2019

(51) Int. Cl.
*E04B 1/24* (2006.01)

(52) U.S. Cl.
CPC .... *E04B 1/2403* (2013.01); *E04B 2001/2415* (2013.01); *E04B 2001/2457* (2013.01); *E04B 2001/2463* (2013.01); *E04B 2001/2466* (2013.01)

(58) Field of Classification Search
CPC ..... E04B 1/2403; E04B 2001/2466; E04B 2001/2457; E04B 2001/2463; E04B 2001/2415
See application file for complete search history.

(56) References Cited

U.S. PATENT DOCUMENTS 2,399,785 A * 5/1946 Blickensderfer ..... E04B 1/3205 52/643
2,965,399 A * 12/1960 Rizzuto ..... E04B 1/5812 403/100
3,557,500 A * 1/1971 Schmidt ..... E04B 1/3441 52/69
3,785,108 A * 1/1974 Satchell ..... E04O 3/11 52/645
4,156,433 A * 5/1979 Beaulieu ..... E04B 1/3441 135/145
4,244,384 A * 1/1981 Bean ..... E04B 1/32 135/132
4,335,555 A * 6/1982 Southerland ..... E04B 1/2608 52/639
4,673,308 A * 6/1987 Reilly ..... A47F 5/14 403/172
5,890,339 A * 4/1999 Willis ..... E04O 3/11 16/319
5,983,577 A * 11/1999 Hays ..... E04B 1/24 52/640
6,401,422 B1 * 6/2002 Olden ..... E04C 3/005 52/641
7,533,498 B2 * 5/2009 Zeigler ..... E04B 1/3205 135/128
8,468,774 B2 6/2013 Garry
(Continued)

FOREIGN PATENT DOCUMENTS

WO WO-9601930 A1 * 1/1996 ..... E04H 15/64

*Primary Examiner* — Rodney Mintz
(74) *Attorney, Agent, or Firm* — Ferguson Braswell Fraser Kubasta PC

(57) ABSTRACT

A method including placing on a surface a first beam having a first end with a first clevis component opposing a second clevis component. A second beam, including a second end having a third clevis component opposing a fourth clevis component, is placed adjacent the first end on the surface. The first clevis component is connected to the third clevis component. A lifter is connected to the first end and the second end, which are lifted simultaneously from the surface while rotating the first beam and the second beam about the connector until the second clevis component engages the fourth clevis component. Connection between the second clevis component and the fourth clevis component then may be completed.

14 Claims, 26 Drawing Sheets

(56) References Cited

U.S. PATENT DOCUMENTS 9,879,412 B2 * 1/2018 Miyagawa ..... E04B 1/1903
10,260,226 B2 4/2019 Garry
10,472,787 B1 * 11/2019 Johnson ..... E02B 3/06
10,480,143 B1 * 11/2019 Johnson ..... E02B 3/068
10,683,657 B2 * 6/2020 Garry ..... E04B 1/3533
2002/0116893 A1 * 8/2002 Waldrop ..... E04C 3/005 52/843
2003/0031077 A1 * 2/2003 Emms ..... E04C 3/42 365/230.03
2004/0173252 A1 * 9/2004 Bouchard ..... E04H 15/50 135/131
2008/0010912 A1 * 1/2008 Hanson ..... E04C 3/005 52/109
2008/0092481 A1 * 4/2008 Ellen ..... E04C 3/38 52/741.11
2008/0115427 A1 * 5/2008 Wheeler ..... E04B 2/7457 52/86
2011/0113725 A1 * 5/2011 Garry ..... B21D 47/04 52/838
2011/0252717 A1 * 10/2011 Graf Fernandez ..... E21D 11/18 52/71
2012/0272607 A1 * 11/2012 Cooper ..... E04B 1/24 52/655.1
2013/0263548 A1 * 10/2013 Merrifield ..... E04C 3/02 52/646
2013/0334159 A1 * 12/2013 Daas ..... E04C 3/08 212/299
2014/0130436 A1 * 5/2014 Gulbrandsen ..... E04C 3/005 52/506.07
2014/0373471 A1 * 12/2014 Knepp ..... E04C 3/34 52/296
2015/0159361 A1 * 6/2015 Miyagawa ..... E04B 1/1903 403/41
2017/0362812 A1 * 12/2017 Garry ..... E04B 1/3533
2019/0194931 A1 * 6/2019 Garry ..... E04B 1/2403
2019/0352873 A1 * 11/2019 Johnson ..... E02B 3/06
2019/0352874 A1 * 11/2019 Johnson ..... E02B 3/06

* cited by examiner

METHOD AND DEVICES ENABLING RAPID CONSTRUCTION OF BUILDINGS

BACKGROUND

Rapid building construction techniques may include using pre-fabricated parts which are brought to and then assembled at a construction site. Particularly for military applications, and for some civilian applications, such buildings are desirably built as quickly as possible and yet remain durable.

SUMMARY

In general, in one aspect, one or more embodiments relate to a method. The method includes placing a first beam on a surface, the first beam having a first end having a first clevis component opposing a second clevis component. The method also includes placing a second beam on the surface. The second beam includes a second end having a third clevis component opposing a fourth clevis component. The second beam further includes a third end. The second end is placed adjacent the first end. The method also includes connecting the first clevis component to the third clevis component with a connector. The method also includes placing an lifter over the first end and the second end. The lifter includes a lifting mechanism suitable for lifting the first beam and the second beam. The method also includes connecting the lifting mechanism to at least one of the first end and the second end. The method also includes lifting the first end and the second end simultaneously from the surface using the lifting mechanism to rotate the first beam and the second beam about the connector until the second clevis component engages the fourth clevis component. The method also includes completing connection between the second clevis component and the fourth clevis component.

The one or more embodiments also relate to another method. This method includes placing first beams end to end on a surface. Each beam in the first beams is connectable to at least one other beam in the first beams via first pairs of clevis components disposed on ends of the first beams. The method also includes connecting, for all of the first pairs of clevis components, one clevis component of a first beam to another opposing clevis component of a second beam. The method also includes placing second beams end to end on the surface. Each beam of the second beams is connectable to at least one other beam in the second beams via second pairs of clevis components disposed on ends of the second beams. The second beams are spaced apart from the first beams. The method also includes connecting, for all of the second pairs of clevis components, one clevis component of one beam to an opposing clevis component of another beam. The method also includes placing a first A-frame over a first interconnected pair of clevis components in the first beams. The first A-frame include a first lifting mechanism. The method also includes placing a second A-frame over a second interconnected pair of clevis components in the beams. The second A-frame includes a second lifting mechanism. The method also includes connecting the first lifting mechanism to at least one of the first interconnected pair of clevis components in the first beams. The method also includes connecting the second lifting mechanism to at least one of the second interconnected pair of clevis components in the second beams. The method also includes lifting, simultaneously, the first lifting mechanism and the second lifting mechanism until two beams in the first beams completely interlock clevis components and another two beams in the second beams completely interlock clevis components. The method also includes connecting third interconnected clevis components opposing the first interconnected pair of clevis components and connecting fourth interconnected clevis components opposing the second interconnected pair of clevis components.

The one or more embodiments also relate to a structure. The structure includes first beams. Each of the first beams is connected to at least one other beam in the first beams via opposing interlocking clevis components secured by first connectors. A first pair of directly connecting beams in the first beams is disposed at a first angle relative to each other. A second pair of directly connecting beams in the first beams is disposed at a second angle relative to each other. The first angle is different than the second angle. Second beams are also included. Each of the second beams is connected to at least another beam in the second beams via second opposing interlocking clevis components secured by second connectors. A third pair of directly connecting beams in the second beams is disposed at a third angle relative to each other. A fourth pair of directly connecting beams in the second beams is disposed at a fourth angle relative to each other. The third angle is different than the fourth angle. The first angle about equals the third angle and the second angle about equals the fourth angle. A first end beam and a second end beam in the first beams, the first end beam including a first footer and the second end beam including a second footer. The first footer is connected to a first anchor in a surface. The second footer is connected to a second anchor in the surface. A third end beam and a fourth end beam are in the second beams. The third end beam includes a third footer and the fourth end beam includes a fourth footer. The third footer is connected to a third anchor in a surface. The fourth footer is connected to a fourth anchor in the surface. A cross-beam connects a first selected beam in the first beams and a second selected beam in the second beams.

Other aspects of the invention will be apparent from the following description and the appended claims.

DETAILED DESCRIPTION

Figure 1:
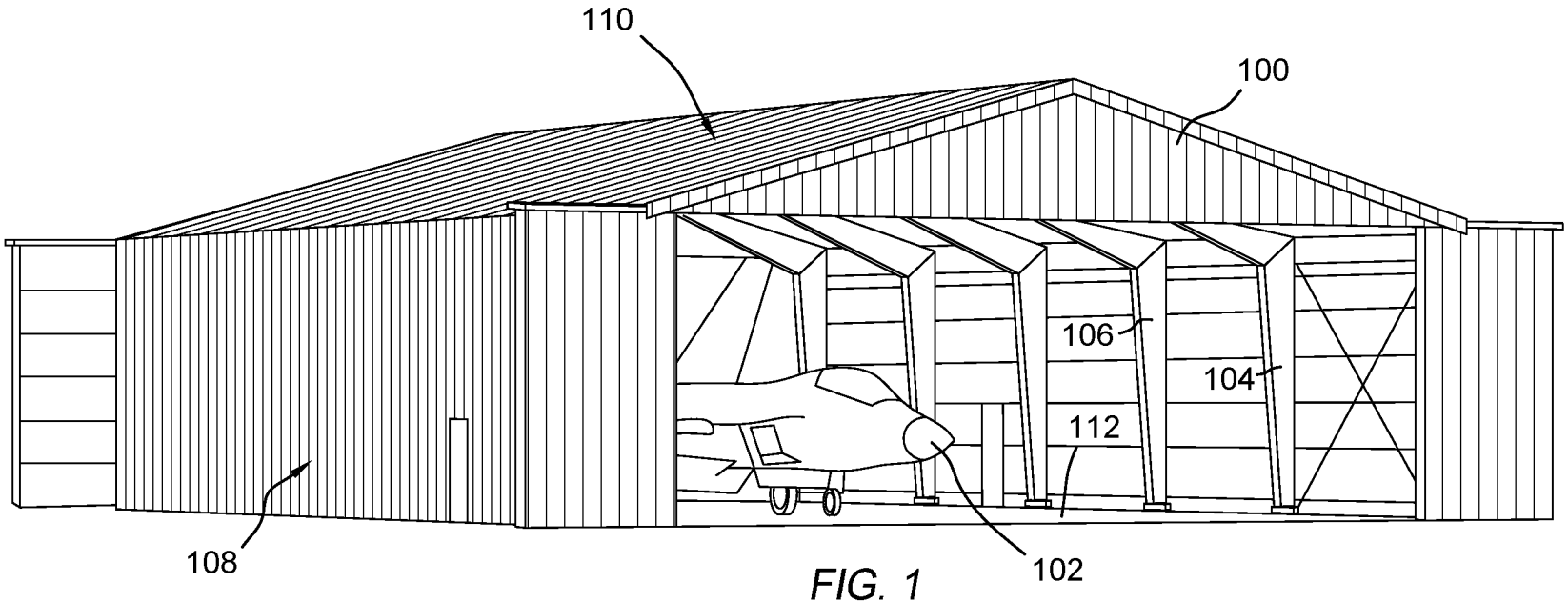
FIG. 1 shows an erected building in accordance with one or more embodiments.

Specific embodiments of the invention will now be described in detail with reference to the accompanying figures. Like elements in the various figures are denoted by like reference numerals for consistency.

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as by the use of the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

The term "about," when used with respect to a physical property that may be measured, refers to an engineering tolerance anticipated by or determined by an engineer or manufacturing technician of ordinary skill in the art. The exact quantified degree of an engineering tolerance depends on the product being produced and the technical property being measured. For a non-limiting example, two objects may be connected "at about" an apex of an A-frame if the two objects are connected to each other at a point within a pre-determined distance of the apex or within an acceptable engineering tolerance of the apex of the A-frame. In a non-limiting example, such a distance could be one centimeter. However, if an engineer determines that the engineering tolerance for a particular product should be tighter, then this value may be reduced. Likewise, engineering tolerances could be loosened in other embodiments, such that this value is increased. In any case, the ordinary artisan is capable of assessing what is an acceptable engineering tolerance for a particular product, and thus is capable of assessing how to determine the variance of measurement contemplated by the term "about."

In general, embodiments of the invention relate to methods and devices for rapidly erecting sturdy buildings. The primary support beams of the building are provided with clevis joints, otherwise known as clevis components, as described below. The clevis components are capable of rotating with respect to each other when joined by a single connector. The support beams are laid out on the ground or foundation, respectively joined at only one clevis component by a single connector, and then lifted one set of support beams at a time through the use of a series lifters. Each joint and pair of support beams are raised sequentially until the building is fully erected. Siding and cross beams may be added during the process. Additional details for this procedure are provided below.

FIG. 1 shows an erected building in accordance with one or more embodiments. The building (100) is erected using the techniques described below. The building (100) is shown as housing an aircraft (102). However, the building (100) could be used for any commercial or residential purpose. As can be seen in the drawings, the building (100) includes a frame composed of support beams, such as support beam (104) and support beam (106). The building also includes siding, such as wall (108), and roof (110) attached to the frame. The building rests on a foundation (112).

In an embodiment, the frame and the siding of the building (100) are composed of steel. However, the building (100) could be composed of other construction materials, such as but not limited to, wood, composite materials, and other metals. The support beams may be composed of a variety of materials and may have a variety of shapes. As shown, the support beams may be paired rails between which is connected a solid, corrugated material, as shown in FIG. 3 through FIG. 6.

Figure 2:
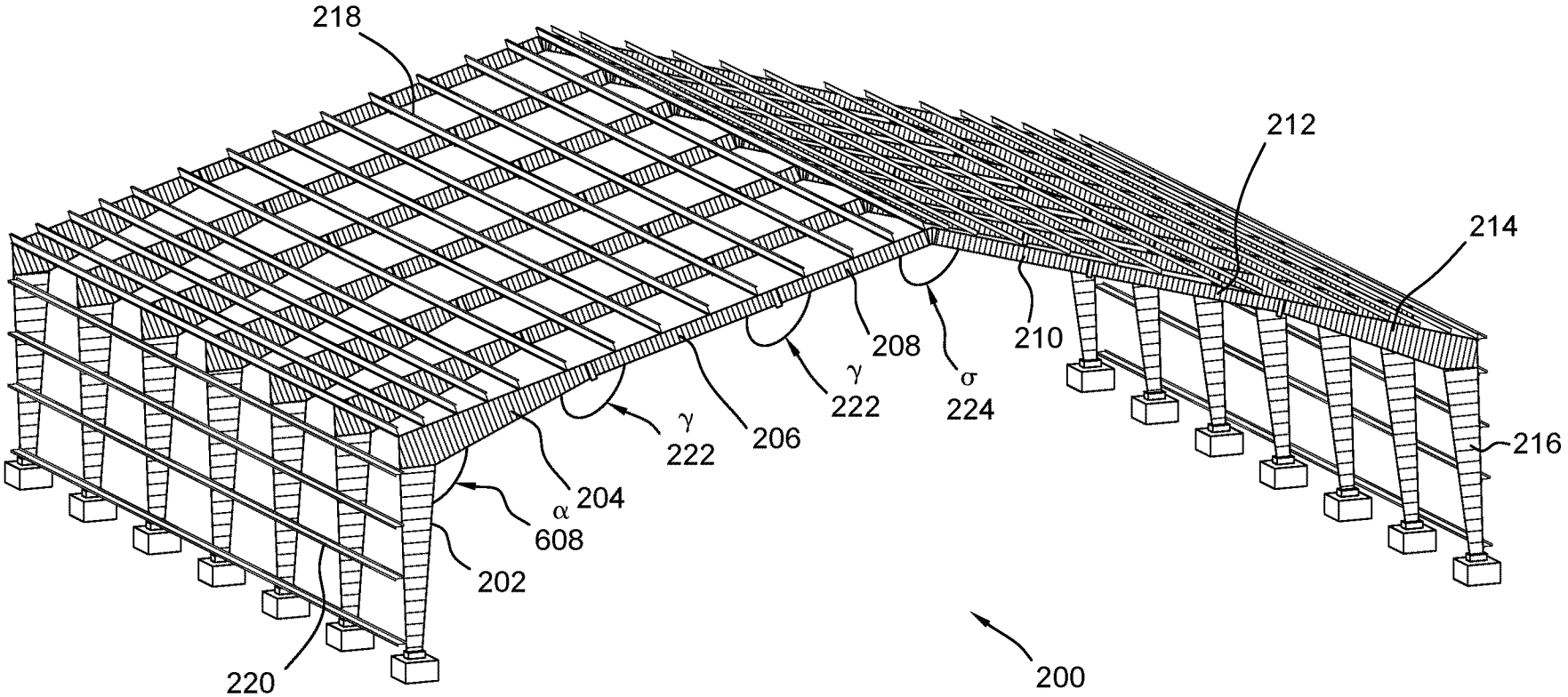
FIG. 2 shows the frame of the erected building shown in FIG. 1 in accordance with one or more embodiments.

FIG. 2 shows the frame of the erected building shown in FIG. 1 in accordance with one or more embodiments. The frame (200) can be conceived of as serried rows of frame elements. A frame element, as used herein, is defined as a series of connected support beams which, taken together, form a cross section of the overall building. Thus, for example, one frame element shown in FIG. 2 includes eight support beams, including first support beam (202), second support beam (204), third support beam (206), fourth support beam (208), fifth support beam (210), sixth support beam (212), seventh support beam (214), and eighth support beam (216).

Each support beam on one side of the frame element may be, but are not required to be, of similar length and construction relative to an opposing support beam on the other side of the frame element. In turn, each frame element may be, but is not required to be, of similar dimensions as the other frame elements.

When the frame elements are arranged as desired, such as shown in FIG. 2, then cross-beams, such as cross beam (218) and cross beam (220), may be added to reinforce the frame (200). Siding and doors, shown in FIG. 1 for example, may be added to the cross-beams and/or the support beams in order to complete the superstructure of the building.

The size of the building is defined by the dimensions and number of the support beams, as well as the number of frame elements. Additional support beams, either vertically or horizontally disposed with respect to the foundation (see foundation 112 in FIG. 1), may increase the height and width of the frame (200). Additional frame elements may be added to increase the length of the building.

As indicated above, not all frame elements need have the same shape. Buildings of complex shape may be constructed by the techniques described below by having differently shaped frame elements arranged in rows, and/or by using differently shaped support beams arranged and connected in a variety of configurations. Thus, the one or more embodiments are not limited to the relatively simple rectangular building with a triangular arch, as shown in FIG. 1 and FIG. 2. In more specific examples, round arches are possible, building additions or extensions are possible, buildings of complex shapes are possible, etc.

FIG. 3, FIG. 4, FIG. 5, and FIG. 6 show close up portions of the frame shown in FIG. 2 in accordance with one or more embodiments. Thus, each of FIG. 3 through FIG. 6 make reference to FIG. 2 and, accordingly, are different magnified views of the frame (200) shown in FIG. 2. Therefore, reference numerals in common with FIG. 2 refer to similar components and have similar properties.

Figure 3:
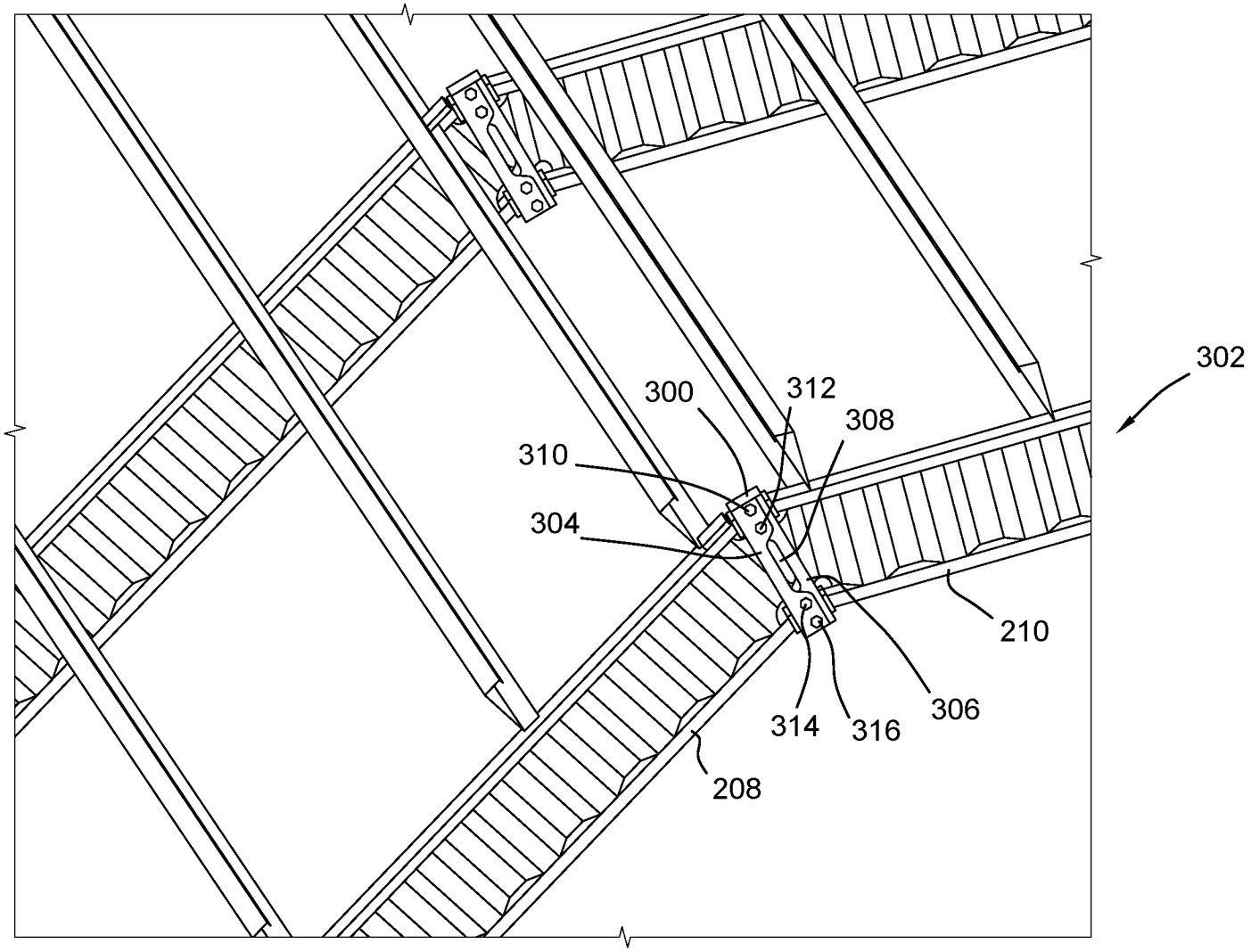
FIG. 3, FIG. 4, FIG. 5, and FIG. 6 show close up portions of the frame shown in FIG. 2 in accordance with one or more embodiments.

FIG. 3 shows a close-up view of the apex (300) of the building at one frame element. The apex (300) is formed at the intersection of the central support beams. For the first frame element (302), the apex (300) is at the intersection of the fourth support beam (208) and the fifth support beam (210) (also shown in FIG. 2). The joined ends of the fourth support beam (208) and the fifth support beam (210) are angled in order to form a triangular arch angled downwardly relative to the foundation (112) shown in FIG. 1.

The joined ends of the fourth support beam (208) and the fifth support beam (210) form an apex joint. The apex joint in this example is formed by a first clevis component (304) attached to the fourth support beam (208) and a second clevis component (306) attached to the fifth support beam (210). In this example, the second clevis component fits inside the first clevis component. To save weight, the clevis components may be provided with cutouts, such as cutout (308), thereby creating two sets of opposed tabs for each individual clevis component.

The clevis components may be secured together via one or more connectors. In this case, two connectors are provided in each set of tabs of the clevis components. Thus, for example, first connector (310) and second connector (312) are in a first end of the two clevis components, while third connector (314) and fourth connector (316) are in a second end of the two clevis components. The connectors may be bolts, screws, pins, etc., or other suitable connectors. Additional details regarding the clevis components are shown in FIG. 5 through FIG. 7C.

Note, however, that the number of connectors may vary in different embodiments, varying from as few as one connector to more than four connectors per pair of support beams. Also note that during at least one stage of the erection of the first frame element (302), only a single connector may be present between the two clevis components so that the clevis components can rotate with respect to each other. A specific example of this procedure is described with respect to FIG. 7A through FIG. 7C, with respect to FIG. 9A through FIG. 9B, and again with respect to FIG. 10 through FIG. 29.

Figure 4:
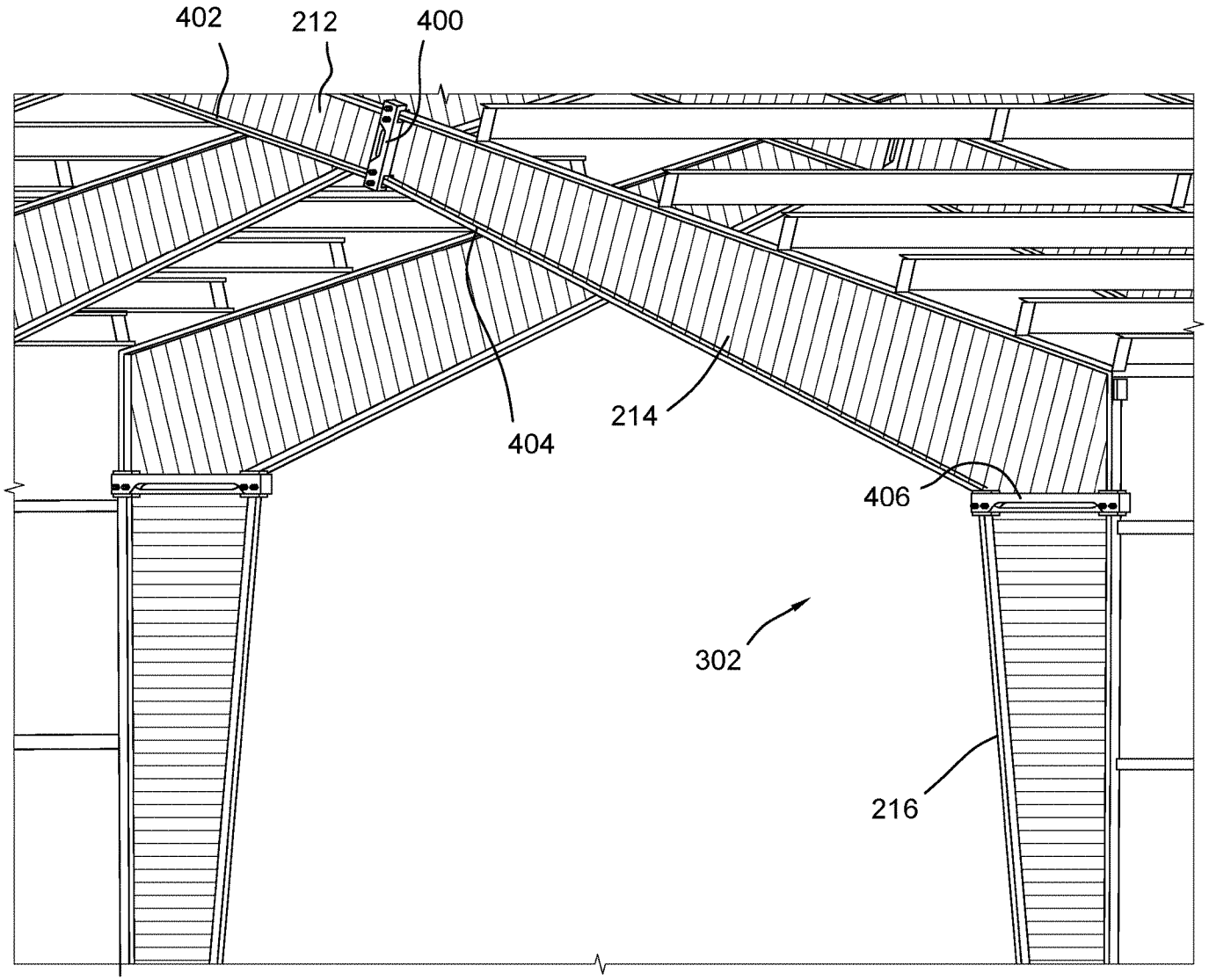

FIG. 4 shows another close-up perspective of the first frame element (302). In this view, the sixth support beam (212), the seventh support beam (214), and the eighth support beam (216) of FIG. 2 are shown in more detail. From this perspective, it can be seen that the angle formed by any two support beams relative to the foundation varies according to the angle formed by the corresponding end edges between any two support beams.

For example, at first joint (400), the angle between the sixth support beam (212) and the seventh support beam (214) is 180 degrees (i.e., the lateral edges of the two support beams, when connected, form substantially a straight line). This arrangement is formed because the corresponding ends of the sixth support beam (212) and the seventh support beam (214), when joined, are substantially perpendicular to the lateral edges of the two support beams (i.e., first lateral edge (402) and second lateral edge (404)). The two support beams (212 and 214), when joined, remain flush with each other (i.e., the two support beams are joined end to end along a straight line) for greater strength.

In another example, at second joint (406), the angle between the seventh support beam (214) and the eighth support beam (216) is obtuse (e.g., 120 degrees). To form this arrangement, the end of the seventh support beam (214) has been cut into the second lateral edge (404) in order to form the desired angle of attachment with the eighth support beam (216), as shown at the second joint (406).

Thus, as used herein, an "end" of a support beam is not just the terminal edge of the support beam, but rather refers to the terminal portion of the support beam that will join with the terminal portion of another support beam. Note, also, that the two support beams (214 and 216), when joined, remain flush with each other (i.e., the two support beams are joined end to end along a straight line) for greater strength, regardless of the orientation of their corresponding support beams relative to each other.

Figure 5:
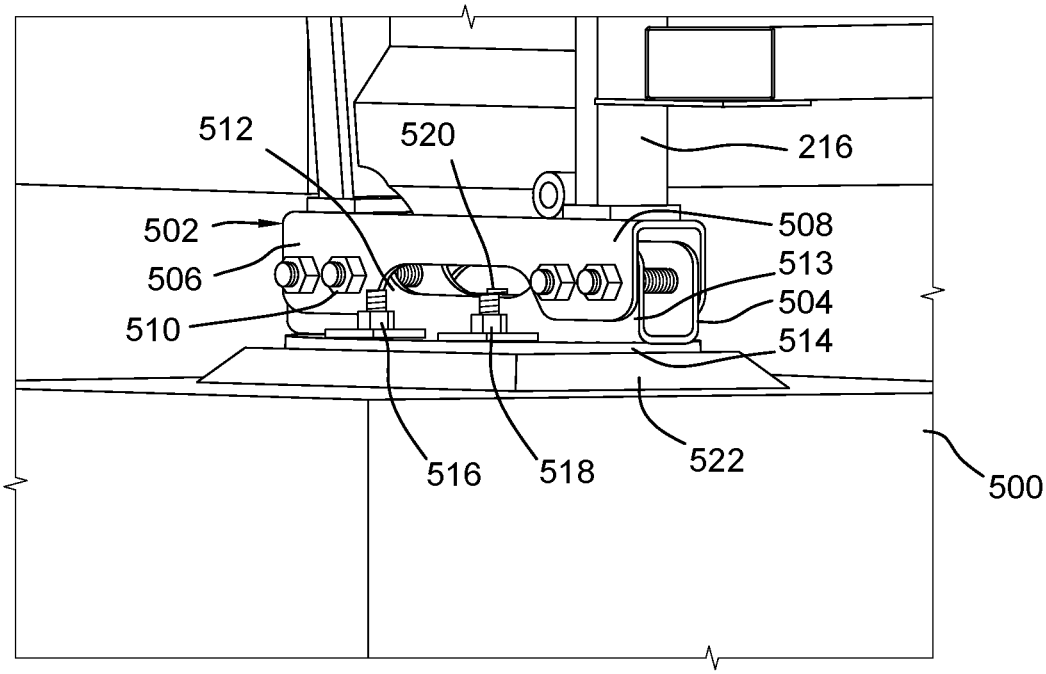

FIG. 5 shows another close-up perspective of the first frame element (302) shown in FIG. 3. In this view, the eighth support beam (216) is connected to an anchor (500). In turn, the anchor (500) is sunk into, bolted into, or otherwise affixed to the foundation. FIG. 5 also shows additional details regarding the clevis components.

In particular, two clevis components are provided, outer clevis component (502) and inner clevis component (504), both of which may be U-shaped, as shown. The two components are sized and dimensioned such that the inner clevis component (504) will fit within the outer clevis component (502) when fully interlocked or fully engaged. Each clevis component has two tabs, such as first tab (506) and second tab (508) on the outer clevis component (502). Correspondingly aligned tabs are also present on the inner clevis component (504), such as third tab (512) and fourth tab (513). Opposing tabs are present on both the outer clevis component (502) and the inner clevis component (504).

Both the outer clevis component (502) and inner clevis component (504) have aligned holes through the respective tabs. In the example shown in FIG. 5, four connectors in the form of bolt and nut assemblies are shown through the holes, with two connectors through each tab. For example, connector (510) is disposed through the first tab (506) of the outer clevis component (502), through the third tab (512) of the inner clevis component (504), through the space between both clevis components, and through the opposing tabs of the inner clevis component (504) and outer clevis component (502). Although four connectors are shown, two in each tab, more or fewer connectors may be present in each tab, or in the clevis components as a whole, as described above.

Additionally, when desirable, the clevis comments may be sized, dimensioned, and shaped to accommodate different functions. For example, as shown in FIG. 5, the inner clevis component (504) has a footer (514), which may be formed integrally with the inner clevis component (504). Alternatively, the footer (514) may be a separate component to which the inner clevis component (504) is attached.

The footer (514) may be bolted or otherwise connected to the anchor (500), which is anchored to or disposed in the ground or foundation. As shown, four connectors are used to anchor the footer (514) to the anchor (500), two connectors on either side of the inner clevis component (504). Connector (516), connector (518), and connector (520) are shown connecting the footer (514) to the anchor (500) for reference.

The clevis comments shown in FIG. 5 may be varied. For example, solid tabs could be used instead of U-shaped tabs. Additional tabs could be present, or only a single tab used in a central portion of a clevis component. The clevis components may have an interleaving arrangement among their tabs when interlocked, rather than one clevis component being fully inside the other clevis component. The inner clevis component (504) could instead be made the outer clevis component (502) in some embodiments (i.e., it is possible that the upper clevis component is the one that fits inside the lower clevis component). More or fewer connectors may be present, both between the clevis components themselves and between the clevis components and other parts of the building structure.

The clevis components may also have different shapes in order to accommodate connection to different types of structures. For example, the inner clevis component (504) shown in FIG. 5 could have a footer (514) shaped to fit over rise (522) projecting from the anchor (500). In another example, the outer clevis component (502) could have additional reinforcing structures designed for attachment to the eighth support beam (216).

Still other variations are possible. Therefore, the example shown in FIG. 5 need not limit the claimed inventions or the other examples provided herein.

Figure 6:
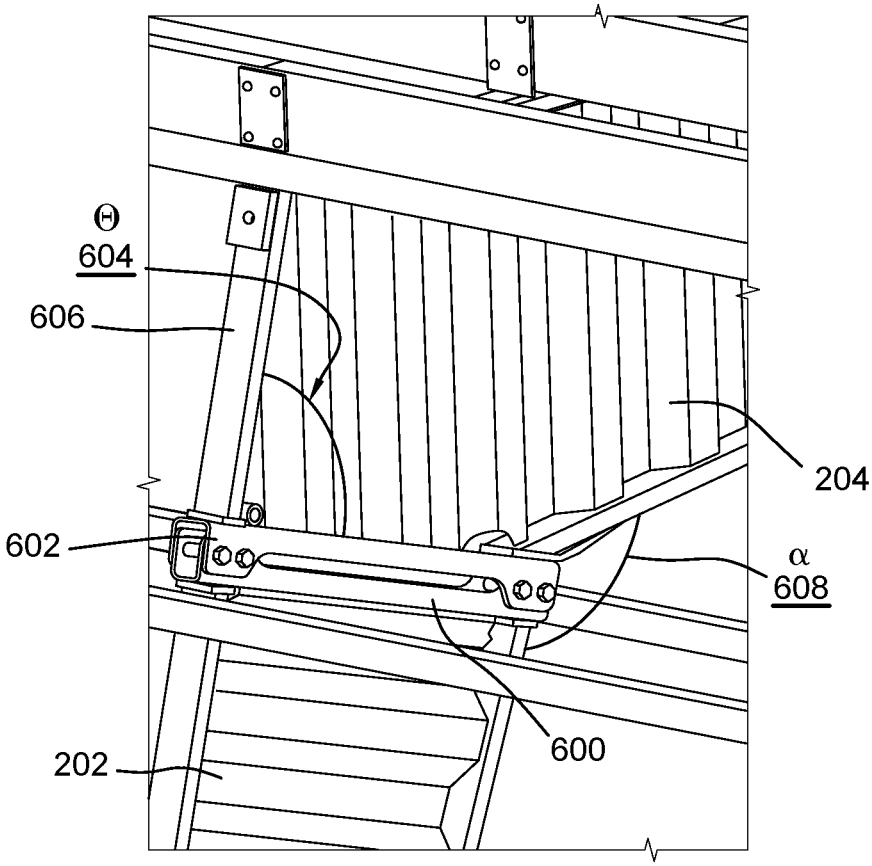

FIG. 6 shows another close-up perspective of the first frame element (302) shown in FIG. 3. In this view, a close-up view is presented of the first support beam (202) connected to the second support beam (204). In order to achieve the desired angle between these two support beams, the locations of the two clevis components relative to their support beams in FIG. 6 are different than the locations of the two clevis components relative to their support beams shown in FIG. 4, for example.

In the example shown in FIG. 6, the inner clevis component (600) attached to the first support beam (202) is attached about parallel to the straight, terminal edge of the first support beam (202). In other words, the inner clevis component (600) is attached to the "top" edge of the first support beam (202).

However, the outer clevis component (602) is connected in a different orientation with respect to the second support beam (204). In particular, the outer clevis component (602) is connected at an angle (604), Θ, with respect to the terminal edge (606) of the second support beam (204). In the example shown, the angle (604) may be 90 degrees, but may be any desirable angle. The angle selected changes the orientation of the first support beam (202) relative to the second support beam (204) when their respective clevis components are fully interlocked. In order to accommodate the outer clevis component being in a straight line at the angle (604), a portion of the second support beam (204) may be cut out, as shown. Thus, the two clevis components will be flush with one another once connected, and yet the angle (608), a, desired between the two support beams be maintained.

By selecting the angle (604), Θ, and the angle (608), a, the orientation of any two support beams may be adjusted as desired in order to establish the desired shape of a segment of the building. In the example of FIG. 6, the two selected angles create the point of intersection where a wall (defined vertically along the first support beam (202)) intersects with a slanting roof (defined vertically and horizontally along the second support beam (204)). The shape of either the wall or the roof may be altered by changing the two referenced angles. The length or shape of either the wall or the roof may be further altered by adding additional support beams, possibly at different angles.

For example, again referencing FIG. 2, the orientation of the first support beam (202) and the second support beam (204) is seen from a wider perspective. However, the width of the roof is extended along the same angle as angle (608), a, relative to the first support beam (202) by the addition of the parallel third support beam (206) and the parallel fourth support beam (208). In other words, the corresponding angle (222), y, between these additional beams (i.e., between second support beam (204) and third support beam (206), and between third support beam (206) and fourth support beam (208)) may be 180 degrees. Stated yet differently, these beams are laid straight on, end-to-end, in order to create a single angle along one side of the roof.

Another change in the angle between support beams can define the apex of the roof of the building. Thus, for example, angle (224), σ, in FIG. 2 is formed by changing the angle at which the fourth support beam (208) is joined to the fifth support beam (210). By cutting or angling the two support beams, the two clevis components will be flush with each other, thereby increasing the strength of the connection, but the desired angle will be achieved.

Note that the shape of the building shown in FIG. 1 and FIG. 2 is relatively simple and uniform. However, by altering the angles between support beams and the use of clevis components as shown, and further by varying the shape and position of frame elements, it is possible to erect buildings of complex shapes using the erection techniques disclosed herein. Furthermore, by varying the shapes of the support beams themselves, such as by using arcuate or curved support beams, or support beams of complex shapes, it is possible to construct buildings of arbitrary shape using the erection techniques disclosed herein.

In this manner, the one or more embodiments provide for the rapid construction of buildings of arbitrary shape while retaining strength under external stresses. The techniques for erecting the building shown in FIG. 1 through FIG. 6 are described with respect to FIG. 9A and FIG. 9B. A specific example of the erection methods are disclosed with respect to FIG. 8 and with respect to FIG. 10 through FIG. 30. The specific details of the procedure for interlocking clevis components are described with respect to FIG. 7A through FIG. 7C.

Figure 7A:
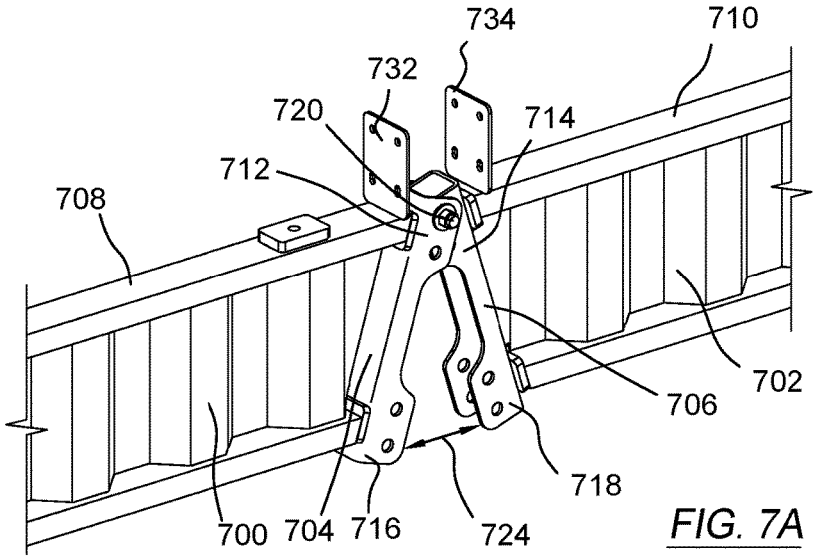
FIG. 7A, FIG. 7B, and FIG. 7C show a close up procedure for interlocking clevis components of support beams in accordance with one or more embodiments.
Figure 7B:
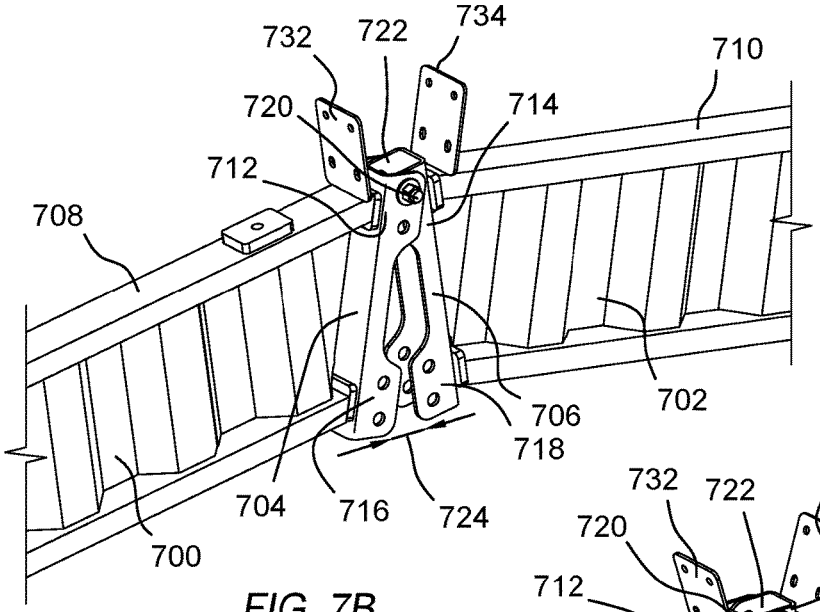
Figure 7C:
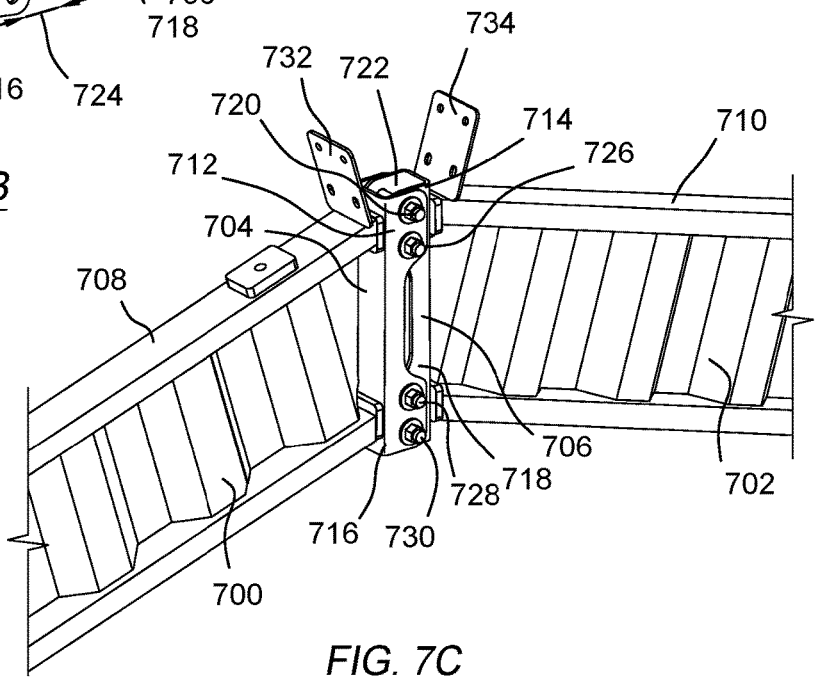

Thus, FIG. 7A, FIG. 7B, and FIG. 7C show a close up procedure for interlocking clevis components of support beams in accordance with one or more embodiments. FIG. 7A through FIG. 7C should be read together and share common reference numerals, which refer to similar objects having similar properties. FIG. 7A shows an initial stage of bringing two clevis components into interlocking relationship with each other. FIG. 7B shows an intermediate stage of bringing two clevis components into interlocking relationship with each other. FIG. 7C shows a final stage of bringing two clevis components into interlocking relationship with each other. In each of FIG. 7A, FIG. 7B, and FIG. 7C, first support beam (700) could be any of the support beams shown in FIG. 2 through FIG. 6, such as fourth support beam (208) shown in FIG. 2. Likewise, second support beam (702) could be any adjacent support beam shown in FIG. 2 through FIG. 6, such as fifth support beam (210) shown in FIG. 2.

Initially, as shown in FIG. 7A, the first support beam (700) and the second support beam (702) lay on a support surface, such as the ground or a foundation. A first clevis component (704) is disposed at the shown end of the first support beam (700). Likewise, a second clevis component (706) is disposed at the shown end of the second support beam (702). In this example, the second clevis component (706) is sized and dimensioned to fit inside the first clevis component (704) when the clevis components are brought into interlocking relationship.

The fit between the clevis components may be varied. The fit may be loose (i.e. the opposing clevis components do not touch). The fit may form a tension bond (i.e., the opposing clevis components are forced together and partially held by the outward pressure of the second clevis component (706) against the first clevis component (704)). The fit may be anywhere in between loose and tension bond.

The first clevis component (704), in this example, is disposed at a first acute angle relative to the first lateral edge (708) of the first support beam (700) in order that the first support beam (700) and the second support beam (702) form a desired angle when interlocked, as shown in FIG. 7C. Likewise, the second clevis component (706), in this example, is disposed at a second acute angle relative to the second lateral edge (710) of the second support beam (702) in order that the first support beam (700) and the second support beam (702) form a desired angle when interlocked, as shown in FIG. 7C.

Each clevis component has two sets of tabs, with each tab set having two opposing tabs. Thus, the first clevis component (704) has first tab set (712) of opposing tabs and second tab set (714) of opposing tabs. Likewise, the second clevis component (706) has third tab set (716) of opposing tabs and fourth tab set (718) of opposing tabs.

Initially, as shown in FIG. 7A, the second tab set (714) is placed between and inside the first tab set (712) such that the second tab set (714) and the first tab set (712) are in interlocking relationship. However, initially, the third tab set (716) and the fourth tab set (718) of the two clevis components are left separated and not connected, as shown. A single connector, in this case first bolt and nut assembly (720), is disposed through the first tab set (712) and the second tab set (714), and no other connectors are initially present. In this manner, rotation is possible between the two clevis components while maintaining a connection between the two clevis components.

Turning to FIG. 7B, an intermediate stage of interlocking the two clevis components is shown. In particular, a lifting device, such as the A-frame lifters shown in FIG. 14 through FIG. 28, is connected to the shown ends of the two support beams. For example, the lifting device may be connected to first mounting plate (732) and/or second mounting plate (734). Alternatively, the lifting device may be connected to a single point (722) common to both of the first support beam (700) and the second support beam (702). Any other connection method may be used, so long as lifting causes rotation of the first support beam (700) with respect to the second support beam (702).

After connection, the lifting device lifts up on the two support beams, causing the first support beam (700) to rotate towards the second support beam (702), and vice versa. Thus, the second tab set (714) rotates within the first tab set (712). Likewise, the fourth tab set (718) rotates towards the third tab set (716), and vice versa. The gap (724) between the third tab set (716) and the fourth tab set (718) of the two clevis components thereby narrows, as indicated by the differently sized double arrows used to represent the gap (724) in FIG. 7A and FIG. 7B.

Turning to FIG. 7C, a final stage of interlocking the two clevis components is shown. As the lifting device continues to lift up on the first support beam (700) and the second support beam (702), the first clevis component (704) and the second clevis component (706) continue to rotate towards each other. Eventually the first clevis component (704) and the second clevis component (706) come into full interlocking relationship, as shown in FIG. 7C. Because of the first angle formed between the first clevis component (704) and first lateral edge (708), and the second angle formed between the second clevis component (706) and the second lateral edge (710), a desired angle is formed between the first support beam (700) and the second support beam (702). In this example, the desired angle is angle (224), a, shown in FIG. 2.

Once the first clevis component (704) is fully interlocked with the second clevis component (706), the two clevis components may be further secured. Thus, for example, second, third, and fourth connectors may be disposed through the first clevis component (704) and the second clevis component (706) in the form of second bolt and nut assembly (726), third bolt and nut assembly (728), and fourth bolt and nut assembly (730) disposed through the opposed tab sets of the two clevis components. The additional connectors may increase the strength and durability of the connection between the first support beam (700) and the second support beam (702), and hence increase the strength and durability of the overall frame element once completed.

If desirable, additional components may be present. For example, mounting plates, such as first mounting plate (732) and second mounting plate (734) may be connected to the first support beam (700) (or first clevis component (704)) and to the second support beam (702) (or second clevis component (706)), respectively. The mounting plates may serve as the connection points to which a lifter may be connected in order to lift the first support beam (700) and the second support beam (702) and cause the two clevis components to rotate towards each other, as described above. The mounting plates may also serve as mounts to which cross beams may be connected, such as cross beam (218) shown in FIG. 2. The mounting plates may serve other functions, as well.

Figure 8:
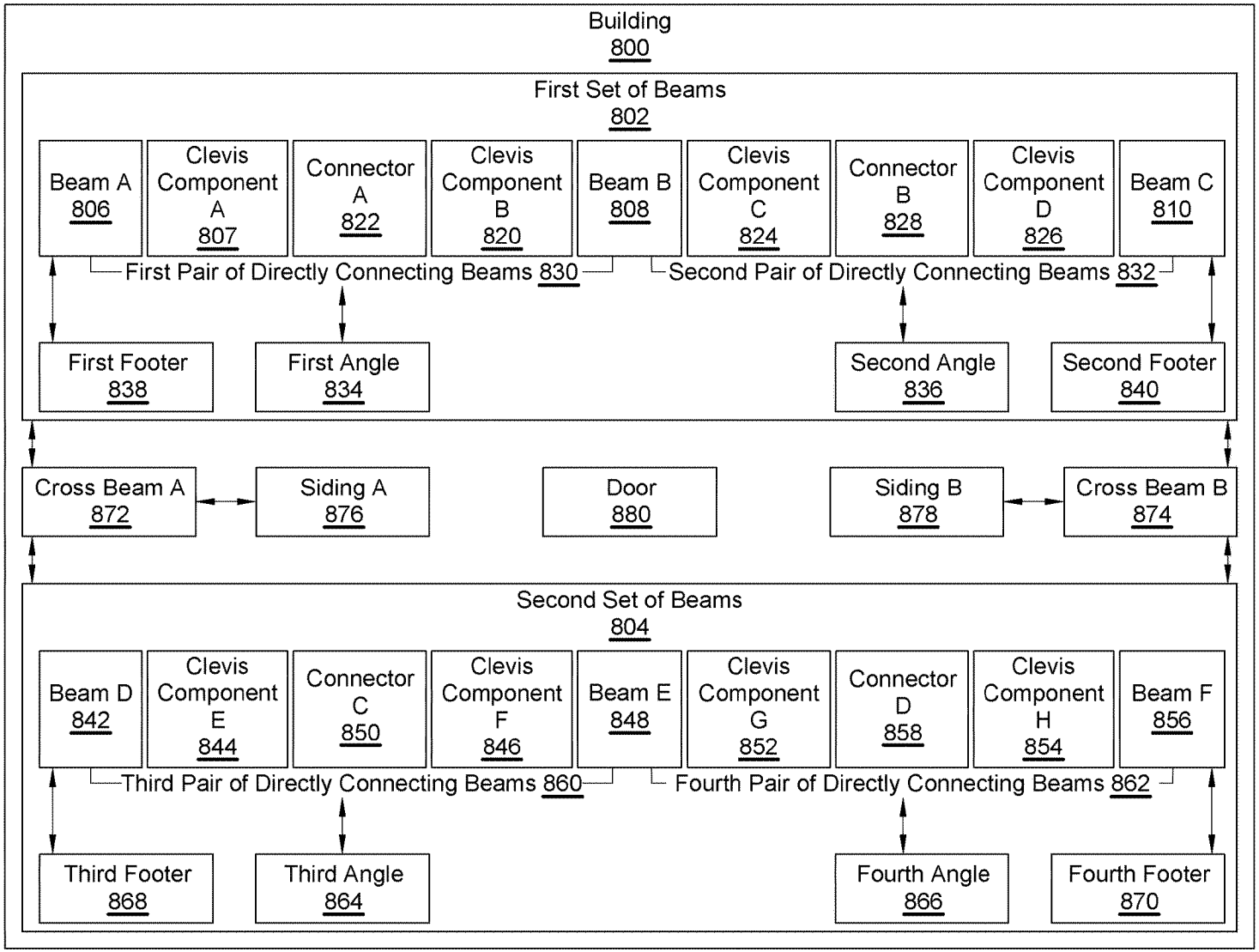
FIG. 8 is a block diagram of a building erected according to the construction methods described herein in accordance with one or more embodiments.

FIG. 8 is a block diagram of a building erected according to the construction methods described herein in accordance with one or more embodiments. Building (800) may be constructed using the methods shown in FIG. 9A and FIG. 9B and using the process shown in FIG. 10 through FIG. 30. The building shown in FIG. 1 through FIG. 6, as well as the building shown in FIG. 30 are specific examples of the building shown in FIG. 8.

Building (800) includes at least two sets of beams, including first set of beams (802) and second set of beams (804). Each set of beams includes multiple beams. Thus, for example, first set of beams (802) includes beam A (806), beam B (808), and beam C (810). Similarly, second set of beams include beam D (842), beam E (848) and beam F (856). In an embodiment, each set of beams may be considered a "frame element," as described above with respect to FIG. 1 through FIG. 6.

Attention is first turned to the first set of beams (802). Each of the first set of beams (802) is connected to at least one other beam in the set via opposing interlocking clevis components secured by sets of connectors. For example, beam A (806) has clevis component A (807) which interlocks with clevis component B (820) of beam B (808). Clevis component A (807) and clevis component B (820) are joined by connector A (822). Similarly, beam B (808) has clevis component C (824) which interlocks with clevis component D (826) of beam C (810). Clevis component C (824) and clevis component D (826) are joined by connector B (828).

Each beam in the first set of beams directly connects to at least one other beam in the first set of beams (802). The term "directly connect," as used herein with respect to any two beams, means that the two beams are immediately adjacent to each other, though they may only touch via their corresponding opposed clevis components. However, all beams in the first set of beams (802) are considered to at least be "indirectly connected" in a chain of beams. The term "indirectly connect," as used herein with respect to any two beams, means that there is at least one intervening beam between any two beams in a chain of beams.

In an embodiment, two pairs of beams may be directly connecting beams. For example, beam A (806) and beam B (808) may be considered to be a first pair of directly connecting beams (830). Similarly, beam B (808) and beam C (810) may be considered to be a second pair of directly connecting beams (832). However, in this example, beam A (806) and beam C (810) are considered to be indirectly connected beams, because they do not directly connect, but they are in the same chain of beams.

The beams may be disposed at a variety of different angles with respect to each other in order to effect the desired shape of a building. Thus, for example, the first pair of directly connecting beams (830) may be disposed at a first angle (834) relative to each other. Similarly, the second pair of directly connecting beams (832) may be disposed at a second angle (836) with respect to each other. The two angles may be different, or may be about congruent. As a specific example, the first angle (834) could be 180 degrees, meaning that beam A (806) and beam B (808) are arranged in a straight line. As another specific example, the second angle (836) could be 90 degrees, meaning that beam B (808) and beam C (810) are perpendicular to each other. In this specific example, both of these angles are present at the same time while all three beams are connected to each other at least indirectly. In yet another specific example, the first angle (834) and the second angle (836) may be selected such that the first set of beams (802) forms a triangular arch. However, the angles may be varied to achieve any other desired shape for the first set of beams (802).

A beam at the end of the first set of beams (802) may be characterized as an "end beam." Thus, in the specific example shown in FIG. 8, beam A (806) may be characterized as a first end beam. In turn, beam C (810) may be characterized as a second end beam.

Each end beam may be associated with a footer. Us used herein, the terms "associated with a footer" or "comprises a footer" mean that the end beam has a clevis component to which is attached or integrally formed a footer, such as footer (514) shown in FIG. 5. The term "comprises a footer" also contemplates the possibility that the clevis component itself is the footer; i.e., the clevis component does not have a base or extension, but rather may be directly bolted to an anchor or to the foundation of the building (800).

Thus, for example, beam A (806) (a first end beam) may be associated with a first footer (838). Likewise, beam C (810) (a second end beam) may be associated with a second footer (840). Each footer may be connected to a corresponding anchor (not shown) in a surface (e.g., the ground or a foundation), or may be directly connected to the surface.

Building (800) may include multiple additional sets of beams, such as second set of beams (804). Thus, attention is now turned to the second set of beams (804). The second set of beams (804) may be considered to be a second frame element in the building (800), as described with respect to FIG. 1 through FIG. 6.

Each of the second set of beams (804) is connected to at least one other beam in the set via opposing interlocking clevis components secured by sets of connectors. For example, beam D (842) has clevis component E (844) which interlocks with clevis component F (846) of beam E (848). Clevis component E (844) and clevis component F (846) are joined by connector C (850). Similarly, beam E (848) has clevis component G (852) which interlocks with clevis component H (854) of beam F (856). Clevis component G (852) and clevis component H (854) are joined by connector D (858).

Each beam in the second set of beams directly connects to at least one other beam in the second set of beams (804). Again, two pairs of beams may be directly connecting beams. For example, beam D (842) and beam E (848) may be considered to be a third pair of directly connecting beams (860). Similarly, beam E (848) and beam F (856) may be considered to be a fourth pair of directly connecting beams (862). However, in this example, beam D (842) and beam F (856) are considered to be indirectly connected beams, because they do not directly connect, but they are in the same chain of beams.

As above, the beams may be disposed at a variety of different angles with respect to each other in order to effect the desired shape of a building. Thus, for example, the third pair of directly connecting beams (860) may be disposed at a third angle (864) relative to each other. Similarly, the fourth pair of directly connecting beams (862) may be disposed at a fourth angle (866) with respect to each other. The two angles may be different, or may be about congruent. As a specific example, the third angle (864) could be 180 degrees, meaning that beam D (842) and beam E (848) are arranged in a straight line. As another specific example, the fourth angle (866) could be 90 degrees, meaning that beam E (848) and beam F (856) are perpendicular to each other. In this specific example, both of these angles are present at the same time while all three beams are connected to each other at least indirectly. In yet another specific example, the third angle (864) and the fourth angle (866) may be selected such that the second set of beams (804) forms a triangular arch in the same (or different) shape as the triangular arch formed by the first set of beams (802). However, the angles may be varied to achieve any other desired shape for the second set of beams (804). For example, the first angle (834) may be about equal to the third angle (864), and the second angle (836) may be about equal to the fourth angle (866).

Again, as above, beam D (842) (a third end beam) may be associated with a third footer (868). Likewise, beam F (856) (a fourth end beam) may be associated with a fourth footer (870). Each footer may be connected to a corresponding anchor (not shown) in a surface (e.g., the ground or a foundation), or may be directly connected to the surface. The manner of connection (directly or indirectly, or the type of connection used) may vary among any or all of the first footer (838), second footer (840), third footer (868), or fourth footer (870).

Together, the first set of beams (802) and the second set of beams (804) may form the framework for a two-frame element building (800). To further strengthen the building, additional components may be attached. Thus, for example, at least one cross beam may be attached that connects a first selected beam in the first set of beams (802) and a second selected beam in the second set of beams (804). Thus, for example, cross beam A (872) may be connected between beam A (806) and beam D (842). Similarly, cross beam B (874) may be connected between beam C (810) and beam F (856).

More or fewer cross beams may be present. Additionally, cross beam may, potentially, cross each other as well as the two sets of beams. For example, it may be possible in some embodiments that one cross beam connects beam C (810) and beam D (842) and another cross beam connects beam A (806) and beam F (856) in such a way that the two cross beams form an "X" shape (a crisscross beam). Yet further, multiple cross beams may connect any two beams. For example, multiple cross beams may connect beam A (806) to beam D (842). Still further, a cross beam could potentially connect two beams in the same set of beams. For example, one or more cross beams could connect beam A (806) to beam C (810). The cross beams, themselves, may have a variety of different shapes, and do not necessarily have to be straight. Thus, many variations are possible, and the examples provided above do not necessarily limit the one or more embodiments.

Additional components or structural elements may be added to the building (800). For example, siding A (876) may be connected to cross beam A (872). Similarly, siding B (878) may be connected to cross beam B (874). The siding may provide for solid walls or a solid roof for the building (800).

Still other components may be provided. For example, a door (880) may be connected to the first set of beams (802), the second set of beams (804), or both. The door may provide egress and ingress through the siding and/or through the sets of beams.

Yet other components may be provided. Additional structures or sub-structures may be added to the building (800). Equipment, such as electrical wiring, plumbing, air conditioners, insulation, duct work, security systems, generators, and the like may be connected to the building. Thus, the embodiments described above again do not necessarily limit the one or more embodiments.

Figure 9A:
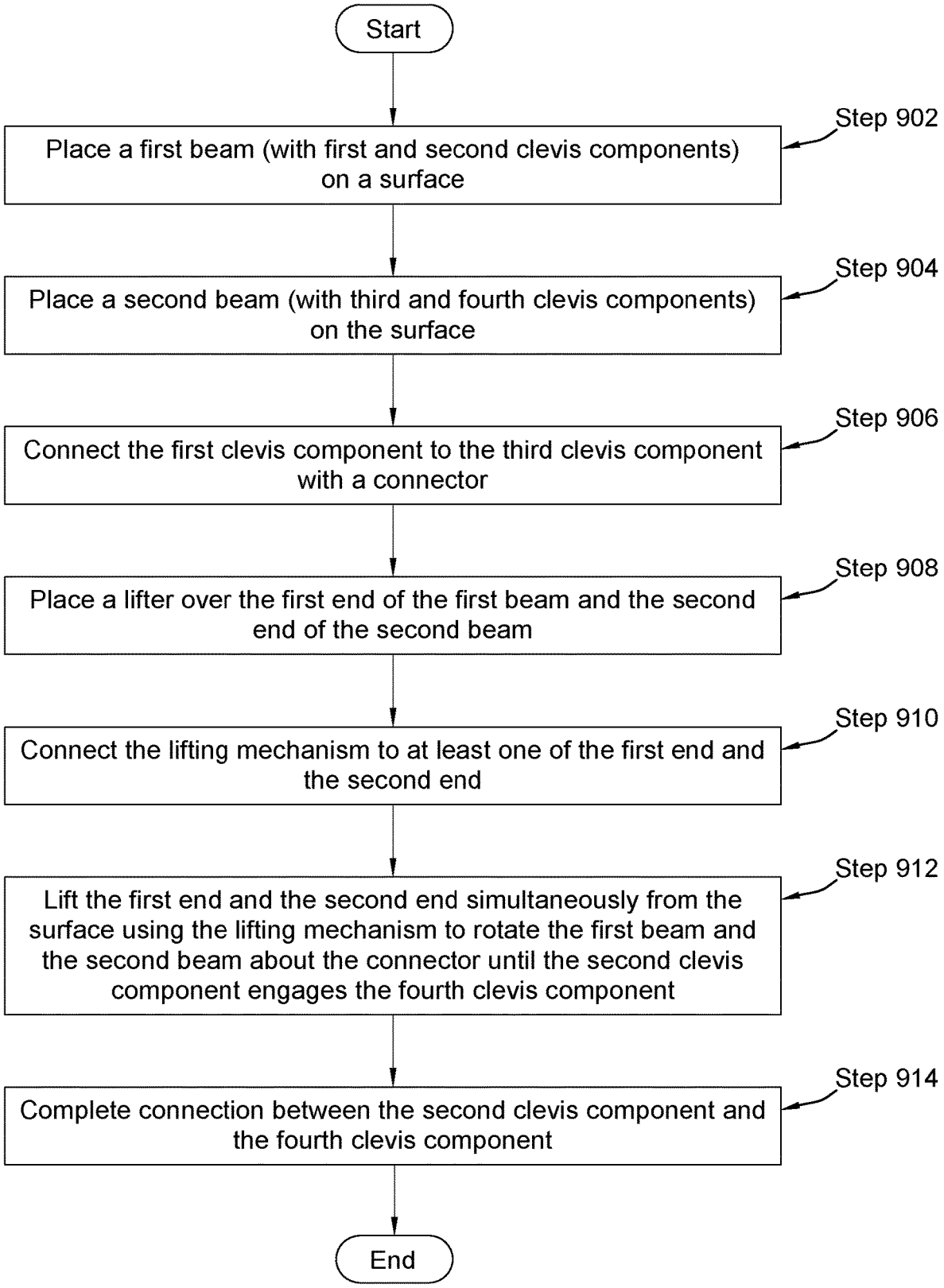
FIG. 9A and FIG. 9B are flowcharts illustrating methods for erecting a building in accordance with one or more embodiments.
Figure 9B:
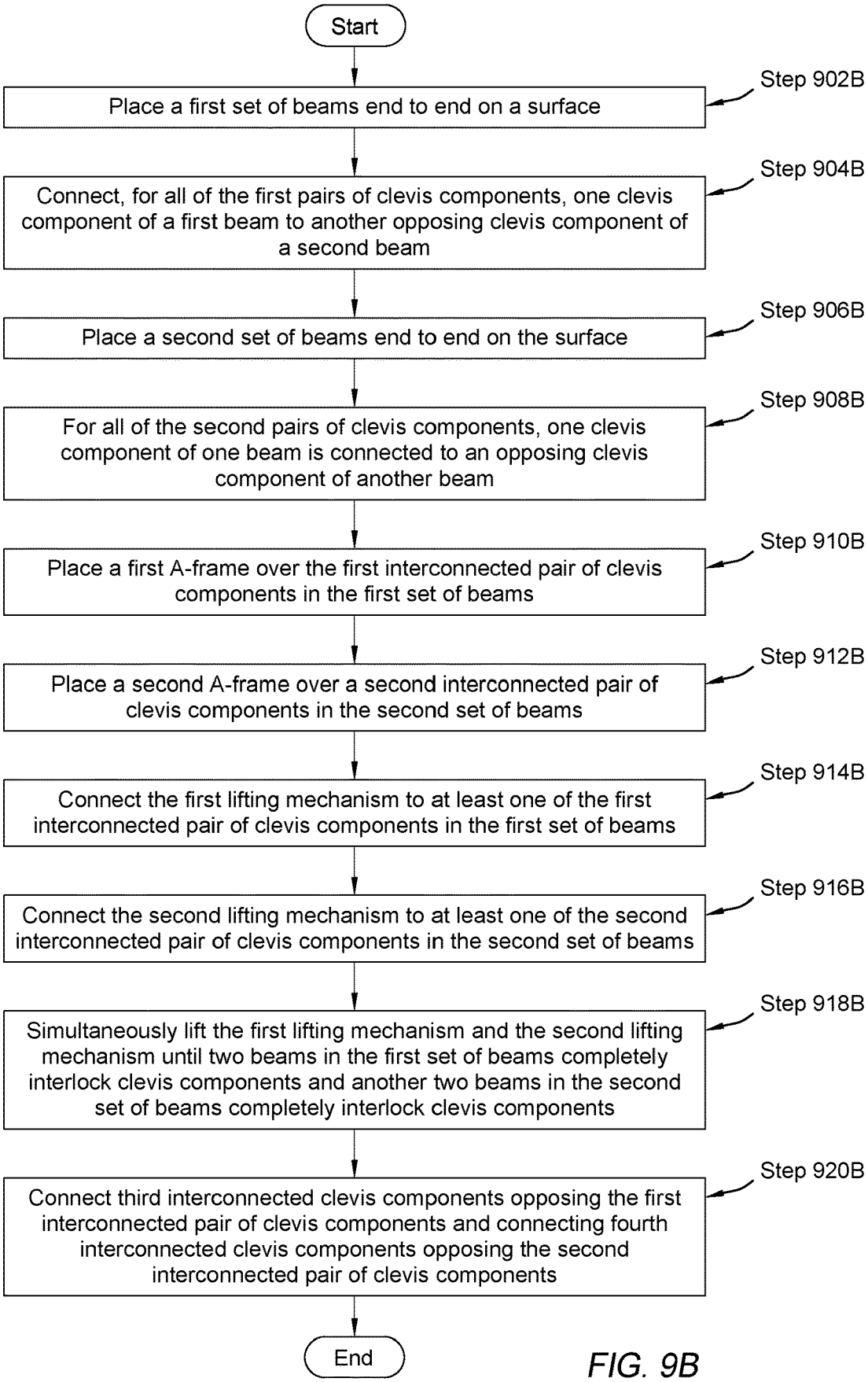

FIG. 9A and FIG. 9B are flowcharts illustrating methods for erecting a building in accordance with one or more embodiments. The methods shown in FIG. 9A and FIG. 9B may result in any of the buildings shown in FIG. 1 through FIG. 8.

At step 902, a first beam is placed on a surface. The first beam may have a first end with a first clevis component opposing a second clevis component at another end of the first beam. The surface may be the ground, a foundation, etc.

At step 904, a second beam is placed on the surface. The second beam may have a second end having a third clevis component opposing a fourth clevis component at a third end of the second beam. The second end is placed adjacent the first end. In other words, the first beam and the second beam are laid end-to-end so that their corresponding clevis components are aligned with each other.

At step 906, the first clevis component is connected to the third clevis component with a connector. For example, the two clevis components may be placed in interlocking relationship with each other. In an embodiment, the sides of one clevis component may fit inside the sides of the other clevis component, though the clevis components may be interlocking in other ways, as described above. A pin, bolt, etc. may be used as the connector. The connector is driven through holes in the clevis components, or may be drilled through the interlocking clevis components.

At step 908, a lifter is placed over the first end and the second end. The lifter may be a mechanism suitable for lifting heavy objects, such as, but not limited to a crane, a pulley system, a hydraulic press, or any other lifting mechanism. The lifting mechanism may also be an A-frame lifter, such as those shown in FIG. 10 through FIG. 30. In the case of an A-frame lifter, the lifting mechanism may be a pulley or winch, which is connected at about an apex of the lifter.

At step 910, the lifting mechanism is connected to at least one of the first end and the second end. The lifting mechanism may be connected to both ends.

At step 912, the first end and the second end are lifted simultaneously from the surface using the lifting mechanism. Lifting causes the first beam and the second beam to rotate about the connector until the second clevis component engages the fourth clevis component. The term "engages" in this context means that the two clevis components come into interlocking relationship, as described above. Note that a single connector is used in this example so that the clevis components are able to rotate with respect to each other. However, it is possible for one more than one connector to be present, so long as the clevis components can rotate with respect to each other while the beams are lifted.

At step 914, connection between the second clevis component and the fourth clevis component is completed. Note that the two clevis components were already connected before this step, not only by the fact that the clevis components were interlocking, but also by virtue of the first connector through the two clevis components. However, at step 914, additional connectors may be added to the clevis components. Alternatively, or in addition, the lone connector between the two clevis components may be reinforced, such as by adding a nut, cap, or welding, etc. Note that step 914 may be optional in some embodiments, because it may be possible that the single connector was sufficient to connect the two beams together.

At this point, the method shown in FIG. 9A may terminate. However, alternatives and additional steps may be possible.

For example, the method shown in FIG. 9A may be used as part of establishing a first frame element, such as shown in FIG. 1 through FIG. 6. However, additional beams may be added to the frame element established through the method shown in FIG. 9A using a similar procedure. Thus, for example, the method may also include placing a third beam on the surface. The third beam includes a fourth end having a fifth clevis component and a sixth clevis component, and further includes a fifth end. The fourth end is placed adjacent the third end of the second beam. The third end of the second beam further includes a seventh clevis component and an eight clevis component.

In this case, the fifth clevis component of the third beam is connected to the seventh clevis component of the second beam with a second connector. Similarly, after lifting the first end and the second end, the lifting mechanism is disconnected from the at least one of the first end and the second end. The lifter is then moved over the third end and the fourth end. Thereafter, the lifting mechanism is connected to at least one of the third end and the fourth end. Then, the third end of the second beam and the fourth end of the third beam are lifted simultaneously from the surface using the lifting mechanism to rotate the second beam and the third beam about the second connector until sixth clevis component engages the eighth clevis component. Thereafter, the sixth clevis component is connected to the eighth clevis component.

Other variations are possible. For example, the fifth end of the third beam may be or include a footer. In this case, the method includes attaching the footer to an anchor anchored to the surface. The footer may have one or more attachment points. In this case, the method also includes attaching the one or more attachment points to the anchor.

The shape of the frame element formed by the method shown in FIG. 9A may be varied as follows. Assume that the first end is at a first angle relative to a first length of the first beam. Assume further that the second end is at a second angel relative to a second length of the second beam. In this case, a bend angle is formed between the first beam and the second beam when the second clevis component engages the fourth clevis component. The shape being formed by the frame element (i.e., the chain of beams) is modified by modifying the angle. The shape may also be altered by altering the size or dimensions of any of the beams being used.

Multiple angles are possible when three or more beams are present. For example, in the variation above where three beams are used, the first end may be at a first angle relative to a first length of the first beam. In this case, the second end is at a second angel relative to a second length of the second beam. A first bend angle is formed between the first beam and the second beam when the second clevis component engages the fourth clevis component. Additionally, the third end is at a third angle relative to the second length of the second beam. The fourth end of the third beam is at a fourth angle relative to a third length of the third beam. Thus, a second bend angle is formed between the second beam and the third beam when the sixth clevis component engages the eight clevis component. In an embodiment, the first bend angle is different than the second bend angle.

As an example, of the shape being formed by the frame element, after lifting of the first end, the second end, the third end, and the fourth end, the first beam, the second beam, and the third beam together form half of a triangular arch. However, many other shapes are possible.

For example, additional beams may be attached to the first beam to form a second half of the triangular arch. In this case, ones of the additional beams may be lifted by sequentially moving the lifter between interlocking ones of additional clevis components on respective ends of the additional beams. The lifting mechanism is used to sequentially lift the interlocking ones of the plurality of additional clevis components. After each corresponding lift with the lifting mechanism, corresponding ones of the additional clevis components are locked to each other. Still further beams may be attached. For example, a second set of additional beams may be attached to at least one of the first beam, the second beam, and the third beam. In this case, ones of still more beams may be lifted by sequentially moving the lifter between second interlocking ones of still more clevis components on respective ends of the beams. The lifting mechanism is used to sequentially lift the interlocking ones of the clevis components. After each lift with the lifting mechanism, corresponding ones of the clevis components are locked to each other.

Attention is now turned to FIG. 9B. FIG. 9B is a method related to FIG. 9A, but includes additional details as a more specific example. The method shown in FIG. 9B does not necessarily limit the method shown in FIG. 9A.

At step 902B, a first set of beams is placed end to end on a surface. Each beam is connectable to at least one other beam in the set via first pairs of clevis components disposed on ends of the first set of beams. The surface is the ground, a foundation, etc. The beams may have a variety of different shapes and sizes, as described above, but the beams all have the described clevis components on their respective ends.

At step 904B for all of the first pairs of clevis components, one clevis component of a first beam is connected to another opposing clevis component of a second beam. This first connection is performed via a single connector in each pair of clevis components, in one embodiment. Additional connectors may be used, so long as the respective clevis components are allowed to rotate with respect to each other.

At step 906B, a second set of beams is placed end to end on the surface. Each beam in the second set of beams is connectable to at least one other beam in the second set of beams via second pairs of clevis components disposed on ends of the second set of beams. The second set of beams are spaced apart from the first set of beams. Note that each set of beams may be considered a frame element, such as described with respect to FIG. 1 through FIG. 6. In other words, at the end of step 906B, two frame elements are laid side-by-side next to each other, though the beams are all lying on the ground.

At step 908B, for all of the second pairs of clevis components, one clevis component of one beam is connected to an opposing clevis component of another beam. Again, a single connector may be used, or multiple connectors may be used so long as the clevis components remain able to rotate with respect to each other.

At step 910B, a first A-frame is placed over a first interconnected pair of clevis components in the first set of beams. The first A-frame includes a first lifting mechanism. The first A-frame may be replaced by some other lifting mechanism, such as any example of a lifter, as described with respect to FIG. 9A.

At step 912B, a second A-frame is placed over a second interconnected pair of clevis components in the second set of beams. The second A-frame includes a second lifting mechanism. The second A-frame may be replaced by some other lifting mechanism, such as any example of a lifter, as described with respect to FIG. 9A.

At step 914B, the first lifting mechanism is connected to at least one of the first interconnected pair of clevis components in the first set of beams. Similarly, at step 916B, the second lifting mechanism is connected to at least one of the second interconnected pair of clevis components in the second set of beams.

At step 918B, the first lifting mechanism and the second lifting mechanism simultaneously lift until two beams in the first set of beams completely interlock clevis components and another two beams in the second set of beams completely interlock clevis components. In other words, the two frame elements are lifted substantially simultaneously at similarly situated joints along the two sets of beams.

At step 920B, third interconnected clevis components opposing the first interconnected pair of clevis components are connected and fourth interconnected clevis components opposing the second interconnected pair of clevis components are connected. To explain further, consider that, during lifting, the beams rotate around the initial connection between the two clevis components until the clevis components come into interlocking alignment with each other. Once in an interlocking alignment, the clevis components are further secured, such as by attaching additional connectors through both sets of clevis components, by welding, etc. Assuming that the initial connection is accomplished at one side of the opposing clevis components, the additional connection is accomplished by connecting a bolt through the other side of the other clevis components (or by some other connection technique). In this manner, the two beams are ultimately locked together against further rotation and are secured to each other.

The method shown in FIG. 9B may be extended. For example, the A-frames (or other lifters) may be moved further along the respective sets of beams (frame elements) in order to lift other pairs of beams. Stated differently, after connecting the clevis components not already connected, the first A-frame is moved over a fifth interconnected pair of clevis components in the first set of beams. Likewise, after connecting the clevis components not already connected, the second A-frame is moved over a sixth interconnected pair of clevis components in the second set of beams. In this case, The first lifting mechanism and the second lifting mechanism are, again, lifted simultaneously until another, separate two beams in the first set of beams completely interlock clevis components and another, different two beams in the second set of beams completely interlock clevis components. Then, seventh interconnected clevis components opposing the fifth interconnected pair of clevis components are connected. Likewise, eighth interconnected clevis components opposing the sixth interconnected pair of clevis components are connected.

Additional steps may be taken. For example, the frame elements may be joined together for additional structural reinforcement. Thus, for example, a cross-beam may be connected to at least one of the first set of beams and to at least one of the second set of beams. Additionally, siding may be attached to the cross-beam (or to the sets of beams themselves) to form a covered building. When desirable, at least one of a door and a window may be attached to the covered building.

The method shown in FIG. 9B may also be extended to anchoring the frame elements. Thus, for example, the first set of beams may further include a first end beam having a first footer and a second end beam having a second footer. Likewise, the second set of beams further includes a third end beam having a third footer and a fourth end beam having a fourth footer. In this case, the method may also include attaching the first footer to a first anchor anchored to the surface; attaching the second footer to a second anchor anchored to the surface; attaching the third footer to a third anchor anchored to the surface; and attaching the fourth footer to a fourth anchor anchored to the surface. Each of the first footer, the second footer, the third footer, and the fourth footer attach at corresponding attachment points on anchors, on the surface, etc.

Still other variations are possible. Thus, the one or more embodiments are not necessarily limited to the example provided in FIG. 9B.

FIG. 10, FIG. 11, FIG. 12, FIG. 13, FIG. 14, FIG. 15, FIG. 16, FIG. 17, FIG. 18, FIG. 19, FIG. 20, FIG. 21, FIG. 22, FIG. 23, FIG. 24, FIG. 25, FIG. 26, FIG. 27, FIG. 28, FIG. 29, and FIG. 30 all show stages in a method for erecting a building in accordance with one or more embodiments. Thus, FIG. 10 through FIG. 30 should be read together as a whole. FIG. 10 through FIG. 30 share common reference numerals that refer to similar objects and procedures. The example shown in FIG. 10 through FIG. 30 represents a specific example of the erection procedures described with respect to FIG. 9A and FIG. 9B, and also represent a specific building under construction, such as those described with respect to FIG. 1 through FIG. 8. However, the example shown in FIG. 10 through FIG. 30 should not be read as limiting the other examples described herein.

Figure 10:
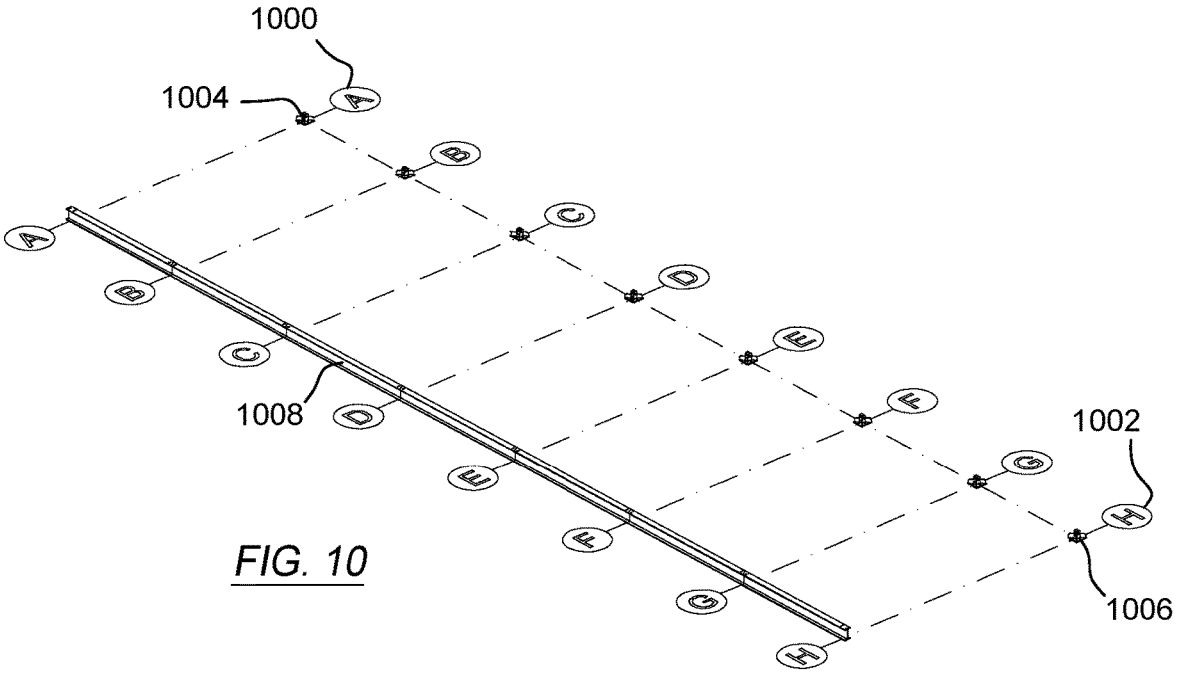
FIG. 10, FIG. 11, FIG. 12, FIG. 13, FIG. 14, FIG. 15, FIG. 16, FIG. 17, FIG. 18, FIG. 19, FIG. 20, FIG. 21, FIG. 22, FIG. 23, FIG. 24, FIG. 25, FIG. 26, FIG. 27, FIG. 28, FIG. 29, and FIG. 30 all show stages in a method for erecting a building in accordance with one or more embodiments.

Referring first to FIG. 10, a series of lines marked by letter pairs, such as "A-A" (1000) through "H-H" (1002) are placed on a surface. Paint, chalk, string, light or simple recording of coordinates may be used to mark the lines. Each line will be the location of a corresponding frame element, as described further below.

A series of anchors are also placed at the terminal ends of each series of lines. Thus, for example, anchor (1004) through anchor (1006) are placed in the foundation or ground at the terminal ends of line "A-A" (1000) through line "H-H" (1002).

Optionally, a resting beam (1008) may be laid on the ground or foundation across the lines. The resting beam (1008) may be a series of smaller beams, whether continuous or discontinuous, and may take a variety of different shapes.

Figure 11:
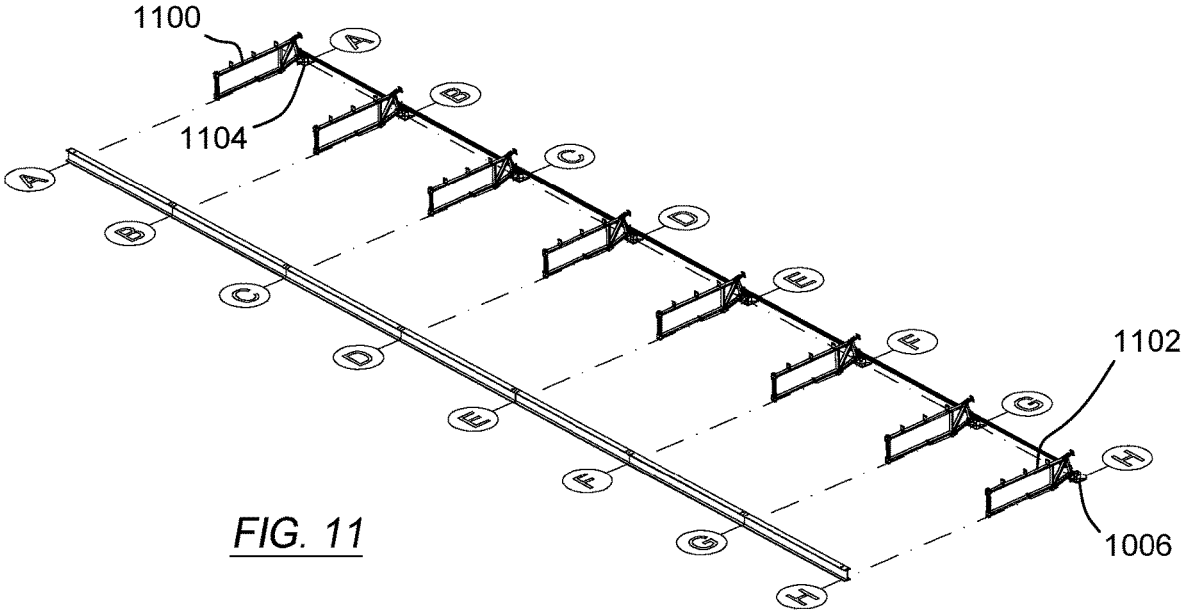

Referring now to FIG. 11, a first series of support beams, from support beam (1100) through support beam (1102) are connected at their clevis components to the corresponding anchors, anchor (1004) through anchor (1006). The first series of support beams are laid along their corresponding lines, as shown. The connection between any two support beams is a single connection, or if multiple connections, the multiple connections still allow for the corresponding clevis components to rotate with respect to the corresponding anchors later in the process.

Thus, for example, at this stage, only a single connector connects one end of one clevis component at point (1104) on the anchor (1004). Thus, the first support beam (1100) will be able to rotate with respect to the anchor (1004) during lifting, as described later. The remaining support beams are similarly situation.

Figure 12:
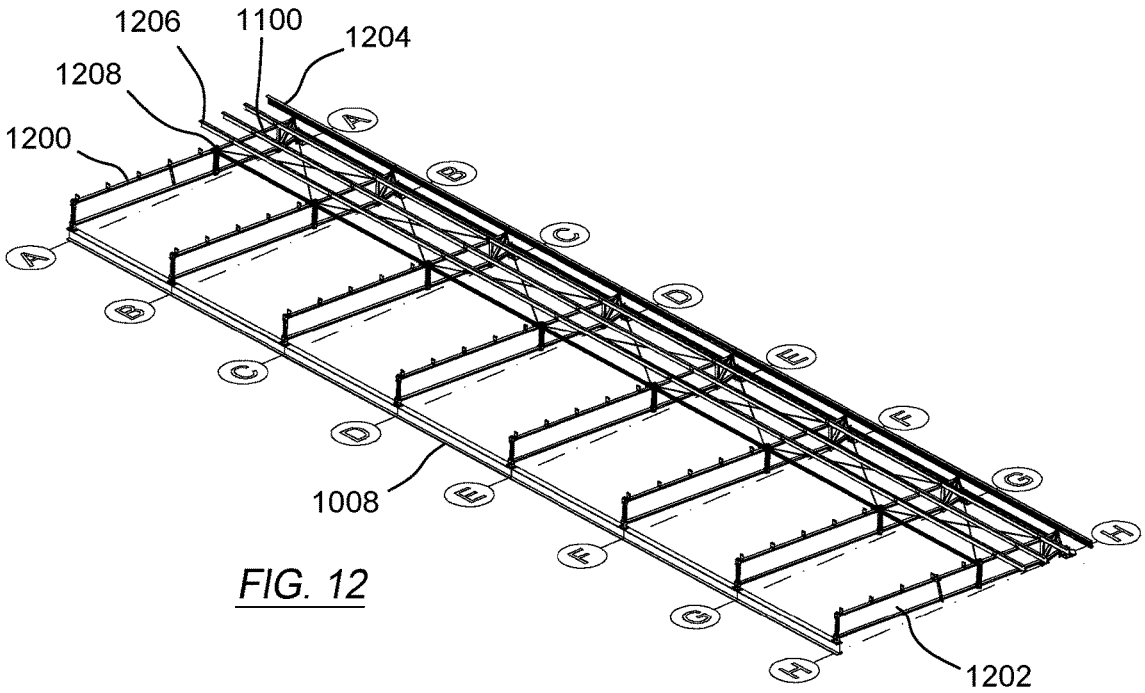

Referring now to FIG. 12, a second series of support beams, from support beam (1200) through support beam (1202) are connected to the first series of support beams, as shown. Again, the connection between any two support beams is a single connection, or otherwise allows for the corresponding clevis components to rotate with respect to the corresponding anchors later in the process. Again, the support beams are laid along their corresponding lines, as shown. Due to the desired angle between the first series of support beams and the second series of support beams, and in order to avoid undue stresses on at least some of the joints, the opposite ends of the second series of support beams rest on the resting beam (1008). Additionally, one or more cross beams, such as cross beam (1204) through cross beam (1206) may be secured to the first series of support beams, the second series of support beams, or both.

At this stage, only a single connector connects one end of one clevis component to another end of another clevis component. Thus, for example, support beam (1100) is connected to support beam (1200) via a single connector through one side of the interlocking clevis components of these two support beams, at point (1208). Accordingly, the support beam (1100) will be able to rotate with respect to the support beam (1200) during lifting, as described later.

Figure 13:
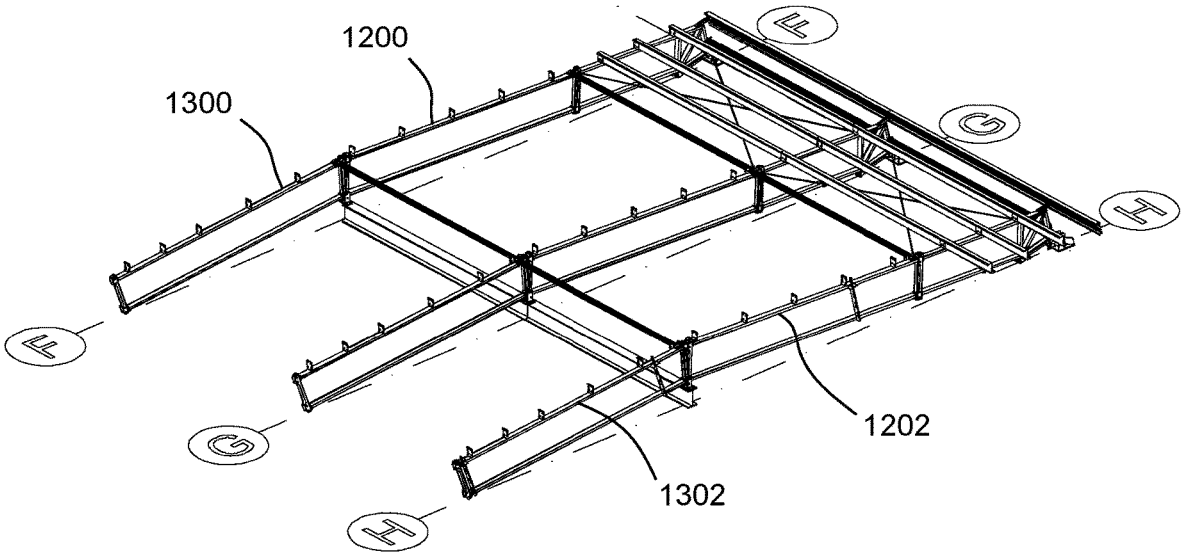

Referring now to FIG. 13, only three of the frame elements are now shown for the sake of simplicity. However, it is assumed that all of the frame elements shown in FIG. 10 through FIG. 12 are being treated similarly.

At this stage, additional support beams are added. In particular, support beam (1300) through support beam (1302) are connected at their respective clevis components to support beam (1200) through support beam (1202). Again, at this stage, only a single connector connects the corresponding clevis components of the various support beams on one side of the corresponding clevis components. Thus, again, all support beams remain rotatable with respect to their opposed support beams. Optionally, additional cross beams could be added.

Figure 14:
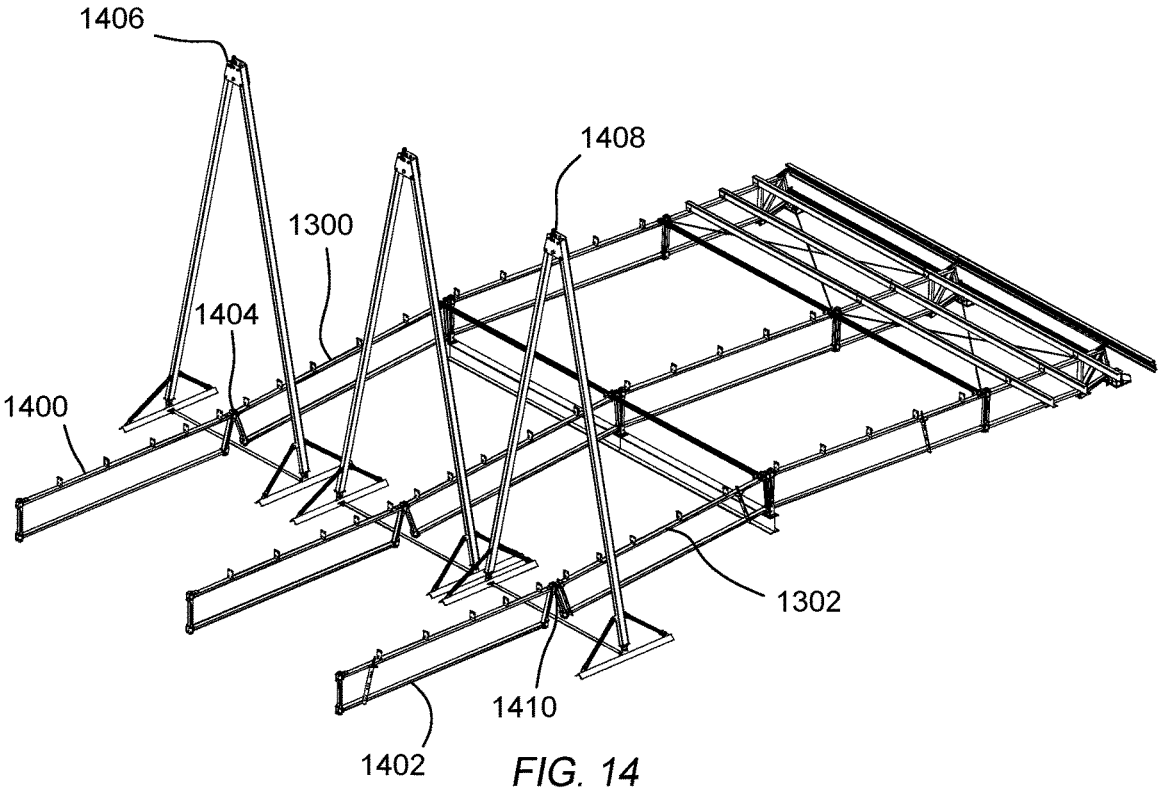

Referring now to FIG. 14, a fourth set of support beams is added, including support beam (1400) through support beam (1402). Again, each support beam is connected via only one connector such that the connector is through one side of the clevis components of the opposing beams. Thus, as a further example, one connector is disposed at point (1404) through one side of the two clevis components of support beam (1400) and support beam (1300).

In addition, at this stage, a line of lifters may be placed over the corresponding joints between the support beams. Thus, for example, A-frame lifter (1406) is placed over point (1404) between support beam (1300) and support beam (1400). Likewise, A-frame lifter (1408) is placed over point (1410) between support beam (1302) and support beam (1402). Additional A-frame lifters in the series are placed accordingly. Note that the lifters could be some other kind of lifting mechanism, as described above.

Figure 15:
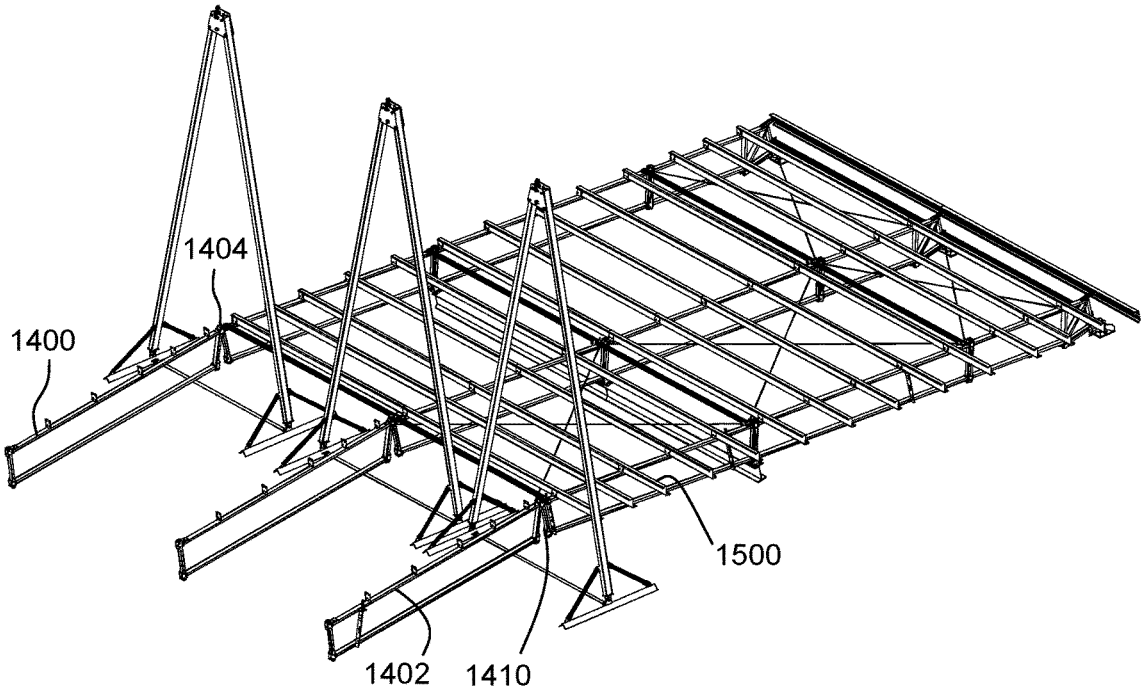

Referring now to FIG. 15, additional cross beams may be connected to the support beams. Thus, for example, cross beam (1500) is connected in a line to all of the support beams, except for support beam (1400) through support beam (1402). Additionally, at this stage, lines, ropes, or other connecting parts of the lifting mechanisms of the A-frame lifters are connected to the corresponding joints, such as at point (1404) and at point (1410). The connecting parts and any lines of the A-frame lifters are not shown for increased clarity of the other components, though generally, the cable or rope is connected from the apex of the A-frame lifters to the joints, such as point (1404) and point (1410). Winches, generators, pneumatic jacks, or other such devices (not shown) may provide the lifting strength and energy used for performing the subsequent lifting action.

Figure 16:
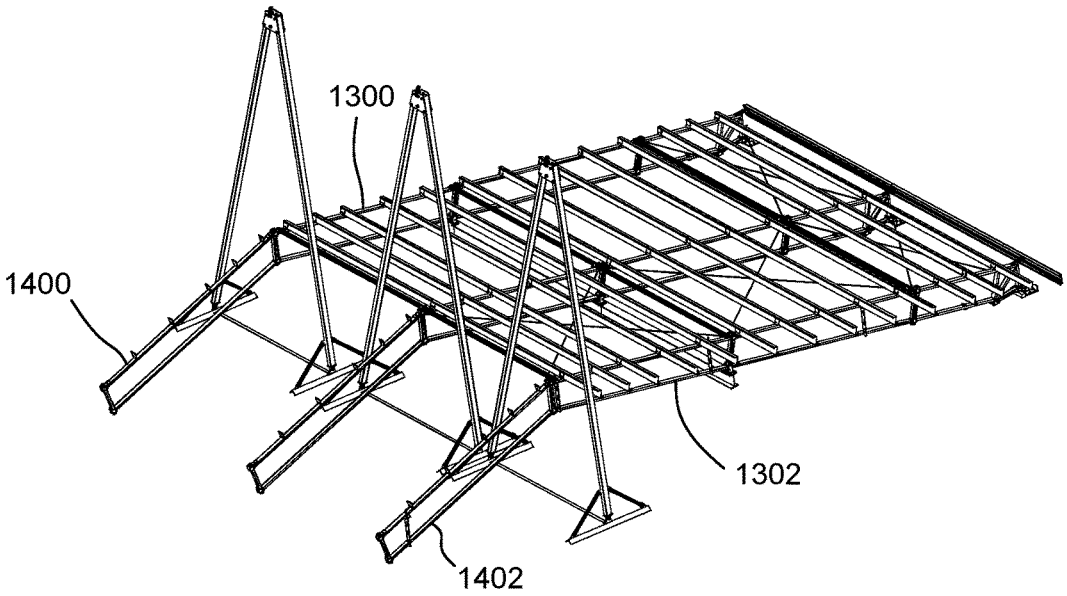

Referring now to FIG. 16, the A-frame lifters are used to lift the corresponding support beams, preferably substantially simultaneously, so that the clevis components of opposing support beams in each frame element come into interlocking relationship with each other. In particular, the support beams rotate with respect to each other during lifting, with the axis of rotation being about the connector through any given pair of clevis components. Thus, for example, after rotation, the clevis component of support beam (1300) comes into interlocking relationship with the corresponding clevis component of support beam (1400). Similarly, the clevis component of support beam (1302) comes into interlocking relationship with the corresponding clevis component of support beam (1402).

At this point, the clevis components of the support beams are locked, joined, or fixed. Locking the support beams can be accomplished by adding additional connectors through other portions of the opposing clevis components. Alternatively, the support beams can be welded or connected by some other means. In an embodiment, four total bolts are used, two connectors through either side of the opposing clevis components, such as shown in FIG. 5, when U-shaped clevis components are used.

Figure 17:
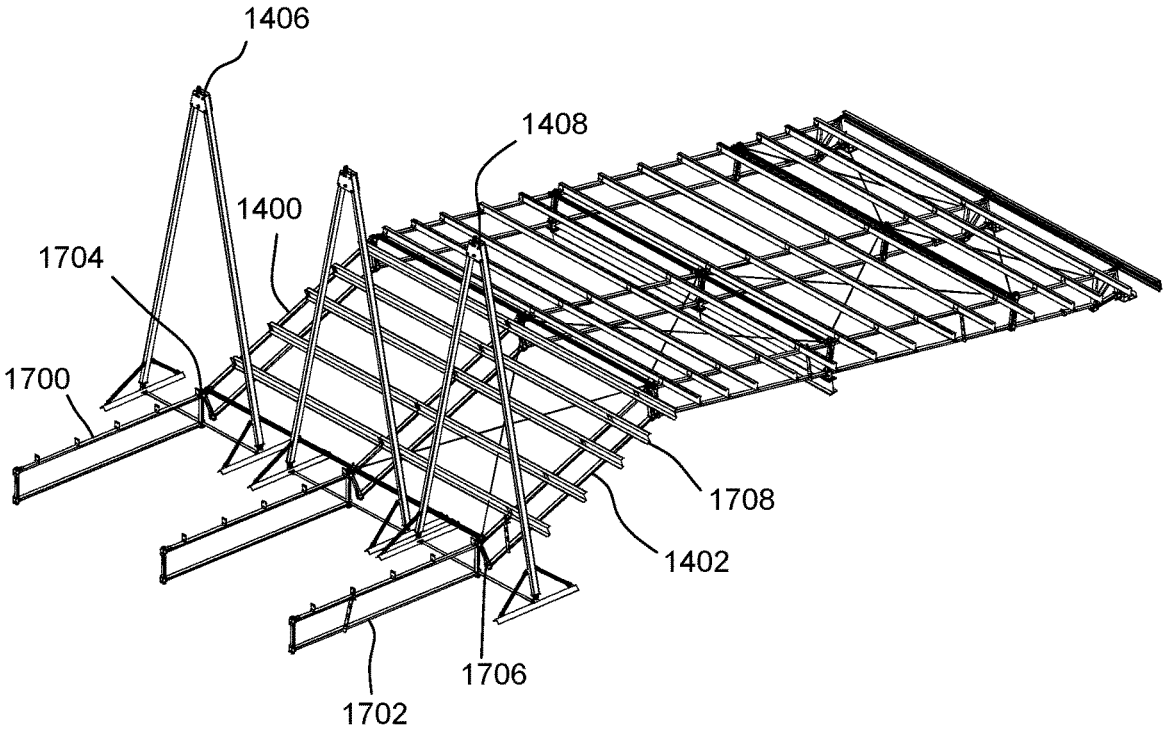

Referring now to FIG. 17, A-frame lifter (1406) through A-frame lifter (1408) are now moved to the opposing ends of support beam (1400) through support beam (1402), respectively. In addition, more support beams are added in the same manner as described above. For example, support beam (1700) is connected to support beam (1400) and support beam (1702) is connected to support beam (1402). Again, each pair of opposing support beams is connected via a single connector, such as at point (1704) and point (1706), through one side of the opposing clevis components so that rotation may take place during lifting of the opposing support beams. Optionally, additional cross beams, such as cross beam (1708), may be connected, as described above.

Figure 18:
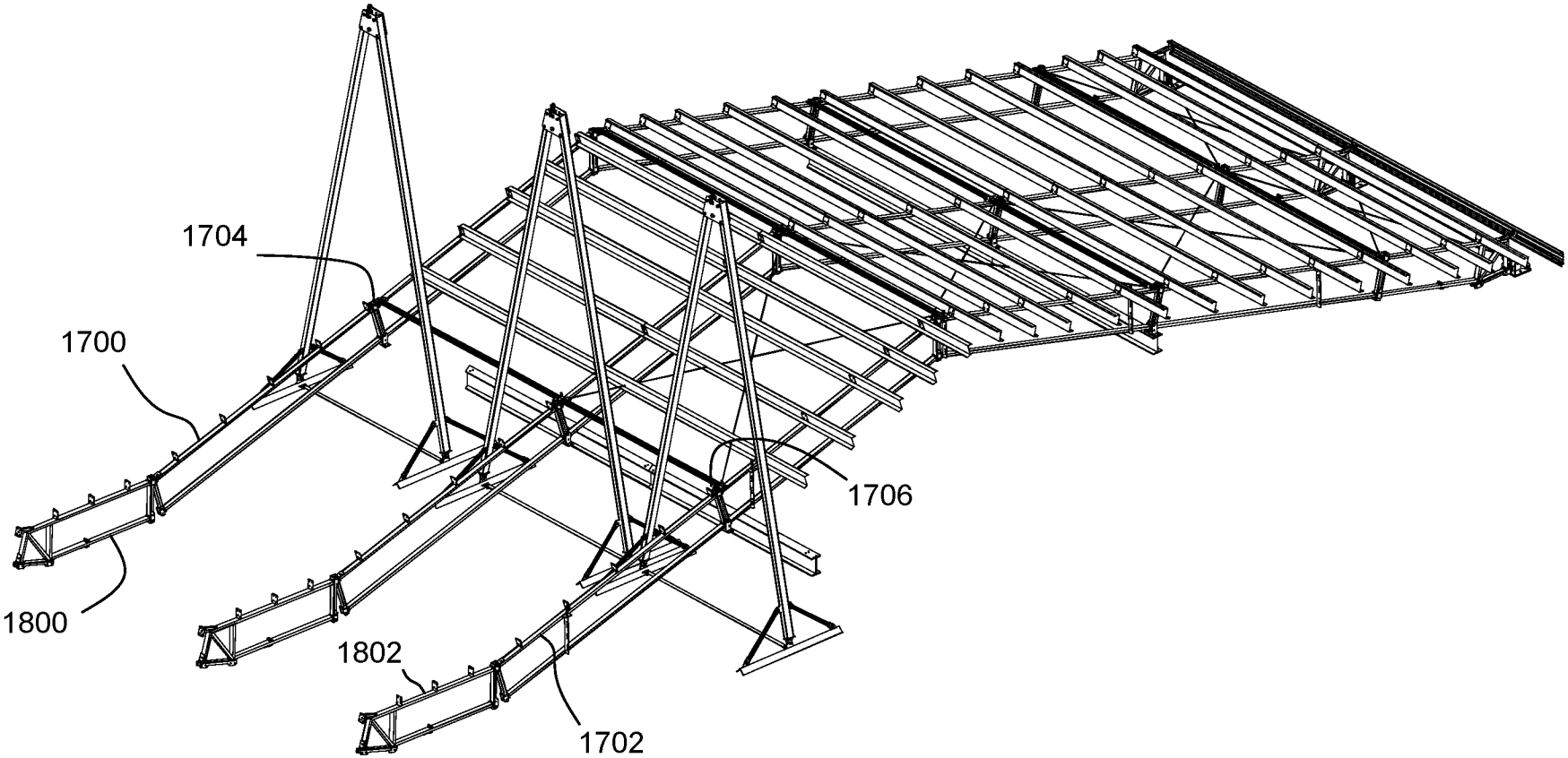

Referring now to FIG. 18, the A-frame lifters are now used to lift the support beams at the joints, such as at point (1704) and point (1706). Again, the support beams rotate about the corresponding connectors in the corresponding opposed clevis components. Lifting continues until the corresponding clevis components come into interlocking relationship with each other. Again, additional connectors are added in order to lock the corresponding support beams that have just been lifted, as described above.

In addition, more support beams are added. For example, support beam (1800) through support beam (1802) are connected to support beam (1700) through support beam (1702), respectively. Again, each pair of support beams are joined by a single connector through their corresponding clevis components in order to allow for rotation between the corresponding support beams during a future lifting operation.

Figure 19:
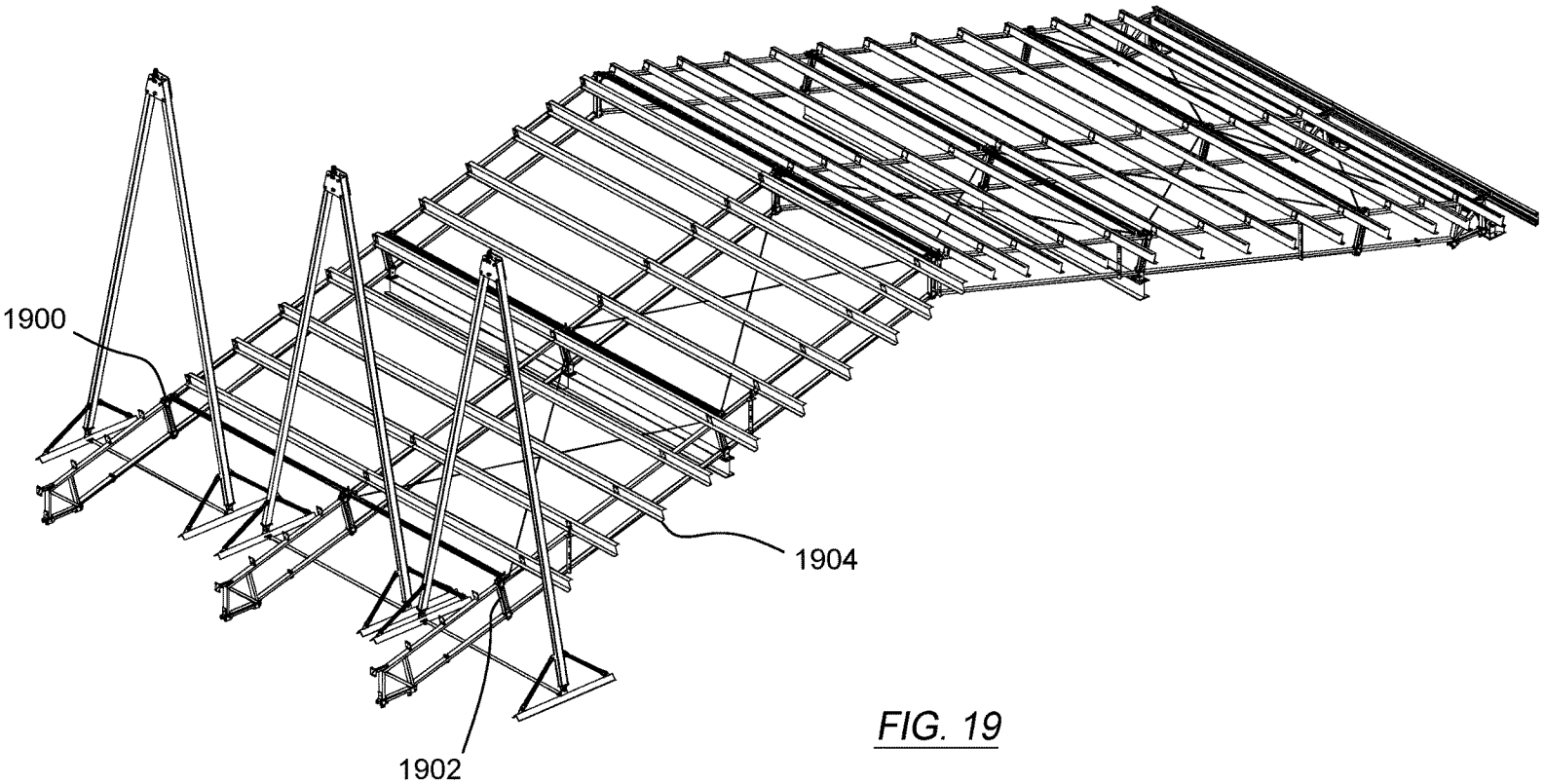

Referring to FIG. 19, the A-frame lifters are again moved further down the line of support beams. The A-frame lifters are now used to lift the support beams at the joints, such as at point (1900) and point (1902). Again, the support beams rotate about the corresponding connectors in the corresponding opposed clevis components. Lifting continues until the corresponding clevis components come into interlocking relationship with each other. Again, additional connectors are added in order to lock the corresponding support beams that have just been lifted, as described above. In addition, more cross beams are added across the support beams, such as cross beam (1904).

Figure 20:
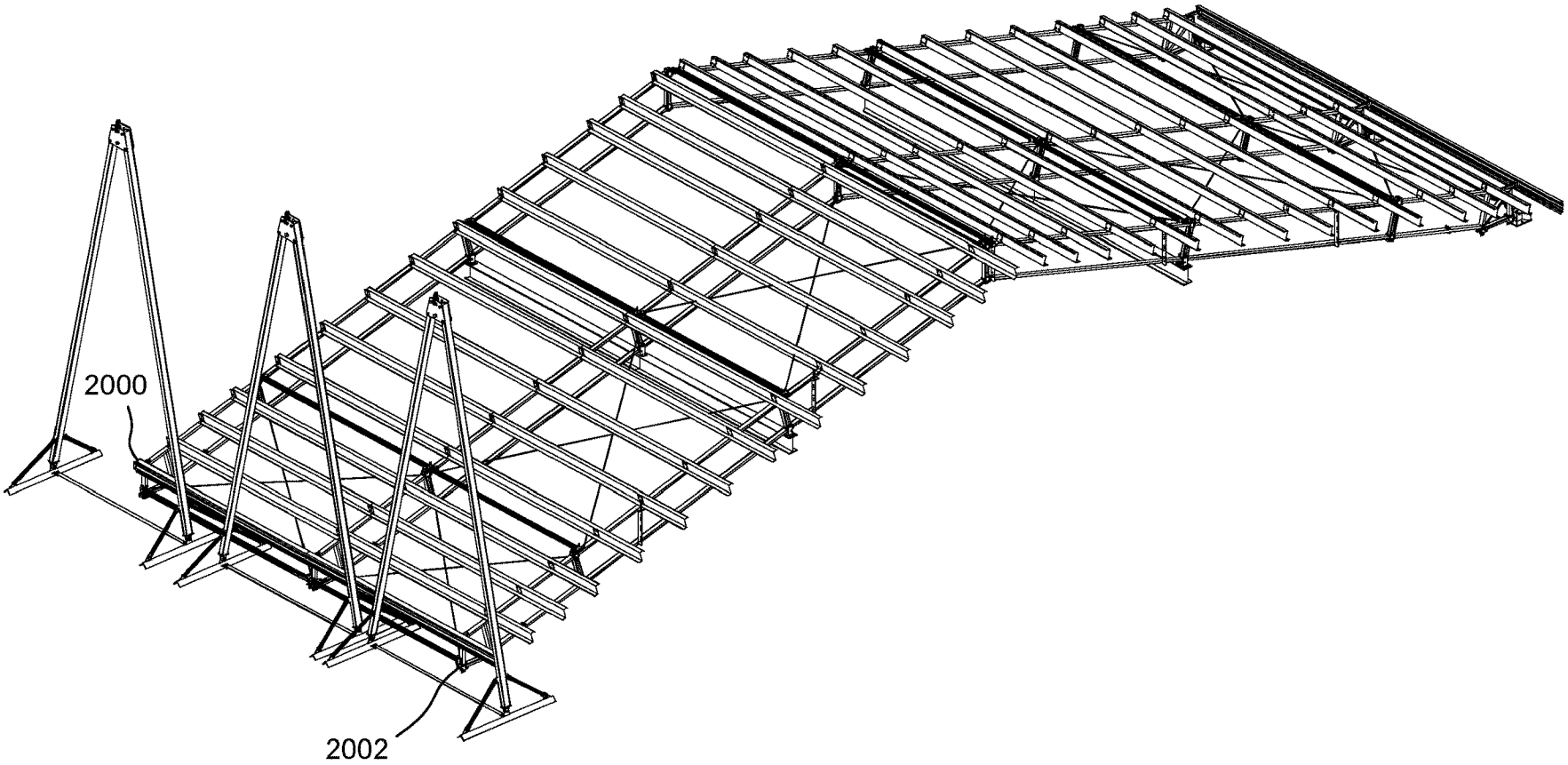

Referring to FIG. 20, a variation in the above procedure occurs, as lifting will now take place between support beams that support the roof of the building and support beams that form the columns that support the roof. In particular, as shown in FIG. 20, the A-frame lifters are moved about to the ends of frame elements, such as end (2000) through end (2002). Using the A-frame lifters, the ends are then lifted above the ground or foundation to a pre-determined height to accommodate additional support beams that will form the support columns for the roof.

Figure 21:
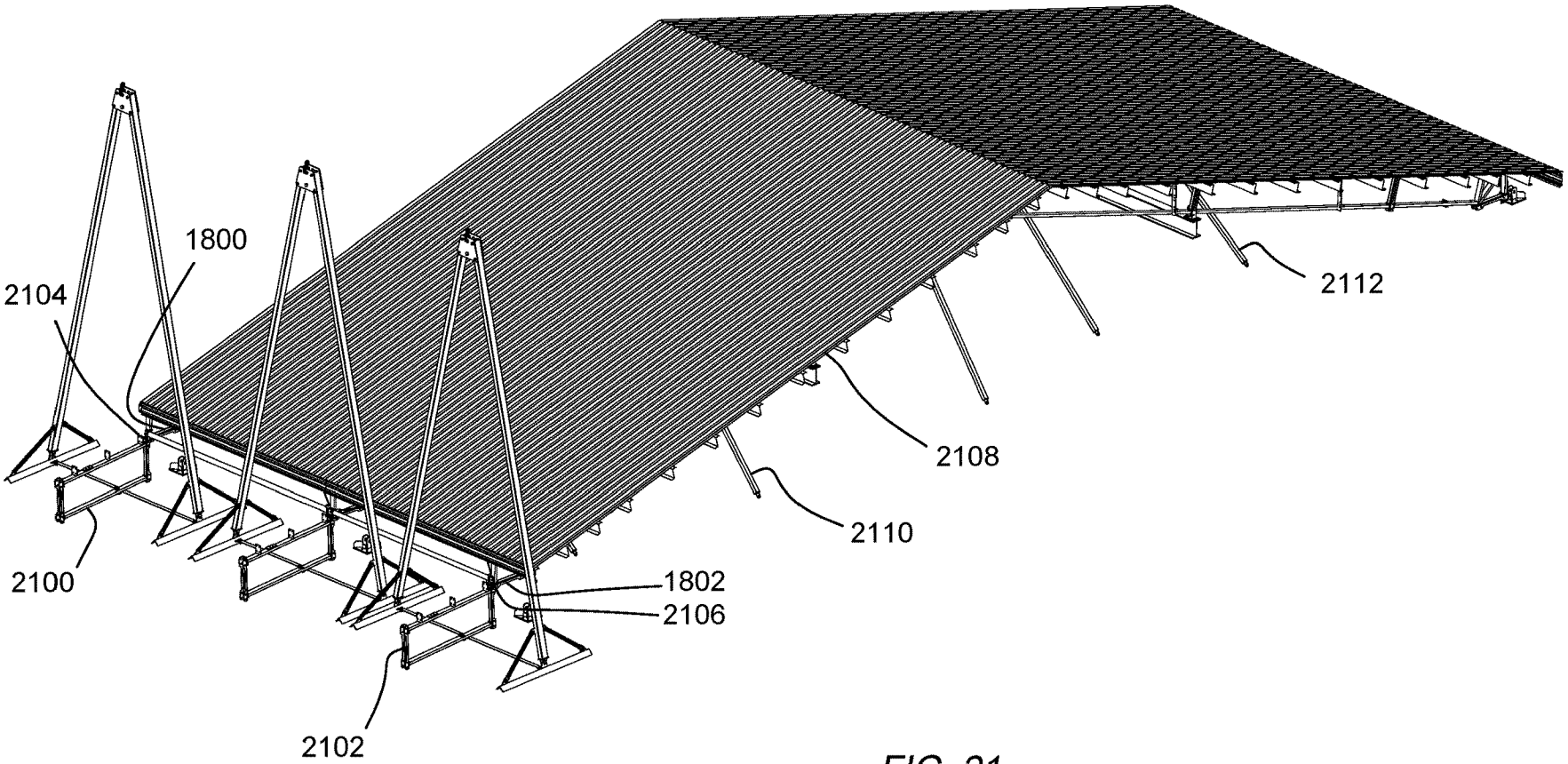

Referring to FIG. 21, the additional support beams that will form the support columns for the roof are now added. Thus, for example, support beam (2100) through support beam (2102) are connected to support beam (1800) through support beam (1802), respectively. The beams are connected via one side of their corresponding clevis components at their joints, such as at point (2104) through point (2106). Again, a single connector may be used in order to ensure that the respective support beams may rotate about their connectors during a future lifting operation.

Optionally, siding (2108) may be connected to the cross beams. In this case, the siding forms the roof of the building. Also optionally, one or more support legs, such as support leg (2110) through support leg (2112) may be connected to the support beams and/or the cross beams in order to support the weight of the roof during the remaining steps of the erection procedure. The support legs may be temporary structures which may be removed after the building has been erected.

Figure 22:
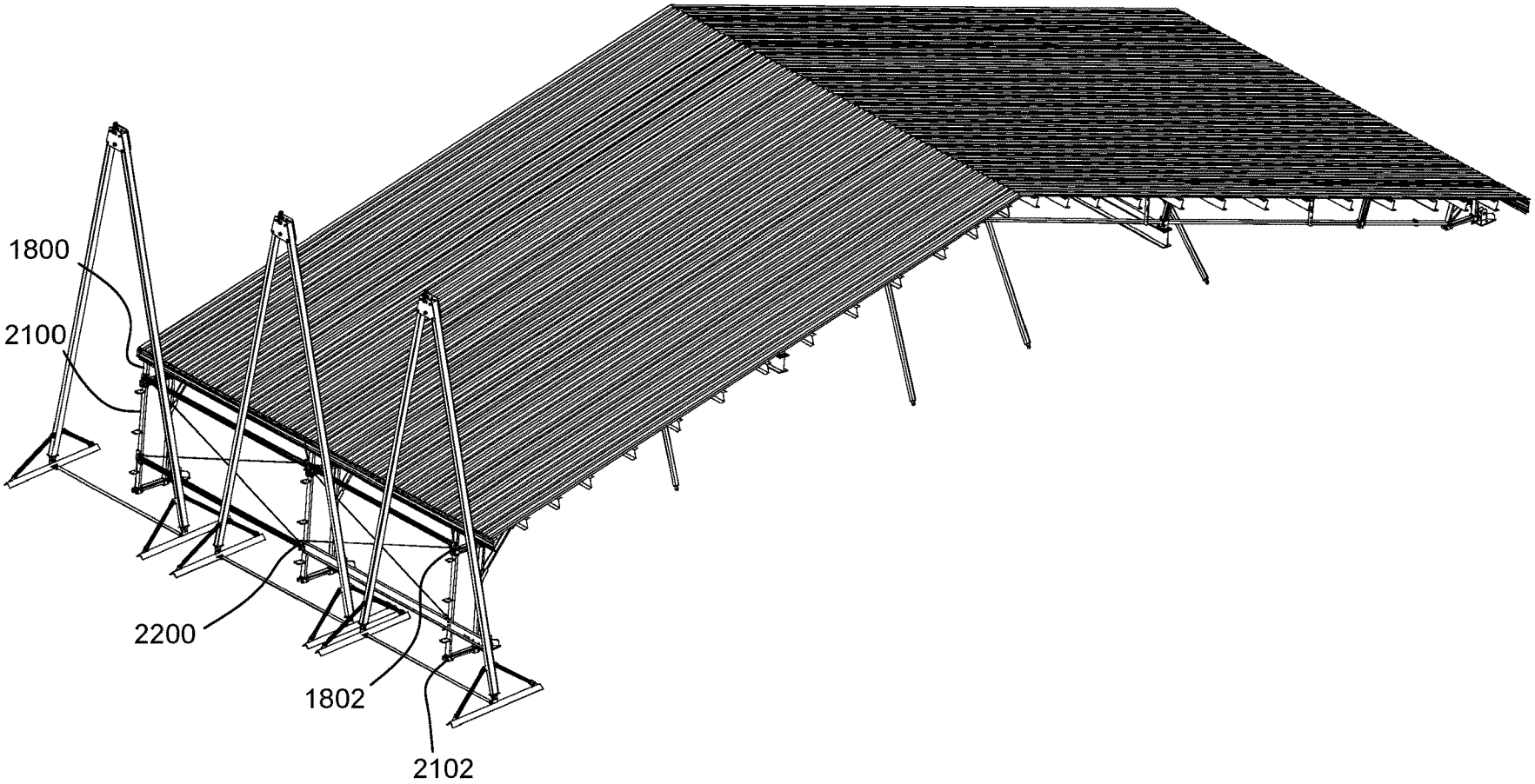

Referring to FIG. 22, the A-frame lifters are now used to lift the joints between support beam (1800) and support beam (2100), along with the other joints through support beam (1802) and support beam (2102). Again, the support beams rotate about their corresponding connectors through one end of the respective clevis components until the respective clevis come into full interlocking relationship with each other. The locations of the clevis components on the beams are as described with respect to FIG. 6, so that the desired angle between the respective support beams is achieved. Optionally, an additional cross beam (2200) may be connected to support beam (2100) through support beam (2102).

Figure 23:
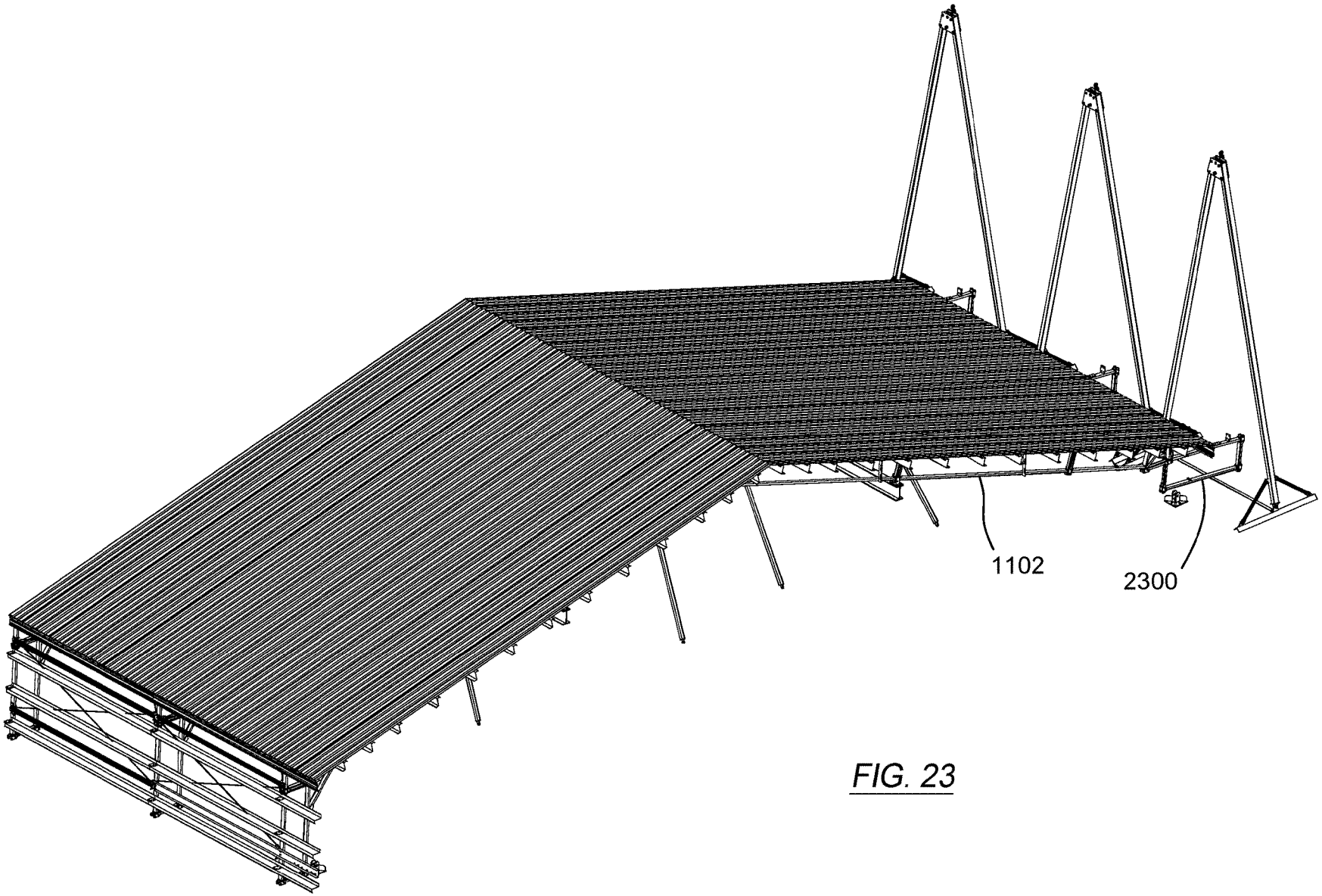

Referring now to FIG. 23, the procedure described in FIG. 21 is now repeated on the other side of the frame elements. In particular, the A-frame lifters are moved to the opposite side of the frame elements, and the building is again lifted far enough to add the additional support beams that will be used as columns for supporting the roof, as described with respect to FIG. 20. Thus, for example, support beam (2300) is connected to support beam (1102) in the manner described above with respect to FIG. 21.

Figure 24:
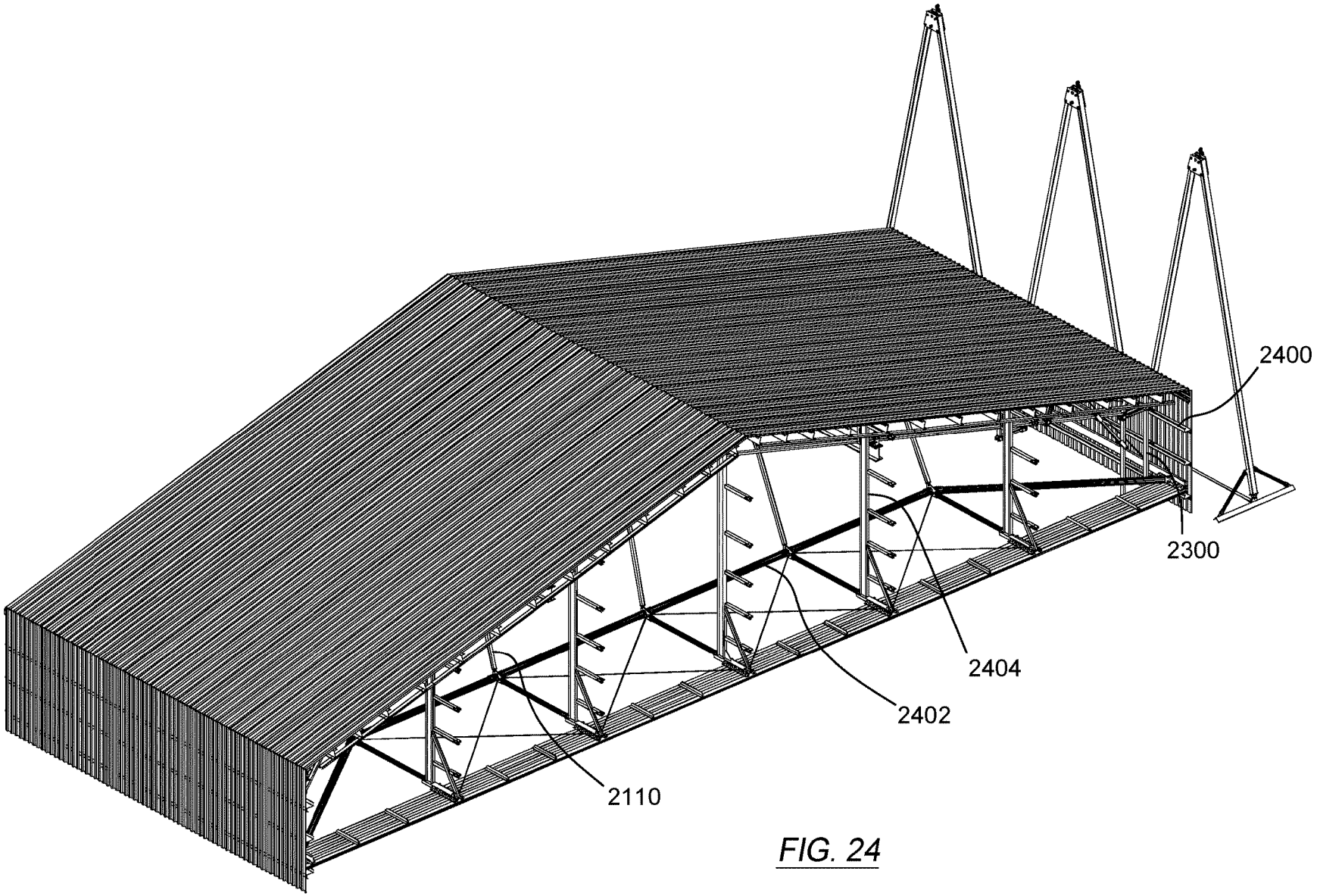

Referring now to FIG. 24, the procedure described with respect to FIG. 22 is now repeated on the other side of the frame elements. At this stage, the A-frame lifters have lifted the support beams used for the columns, such as support beam (2300). Again, the support beams rotate about their connectors through the respective clevis components until the respective clevis components come into full interlocking relationship with each other.

Other parts of the building may now be added. For example, additional cross beams (2400) may be added. Internal framework (2402) may be connected to the support legs, such as support leg (2110). The internal framework (2402) may be permanent, or optionally may be added temporarily for additional support for the building if additional lifting operations are used to add additional support columns. Furthermore, additional columns, such as additional columns (2404) may be connected to the support beams that form the roof (and possibly also anchored into the ground if a low-lying building is being formed).

Figure 25:
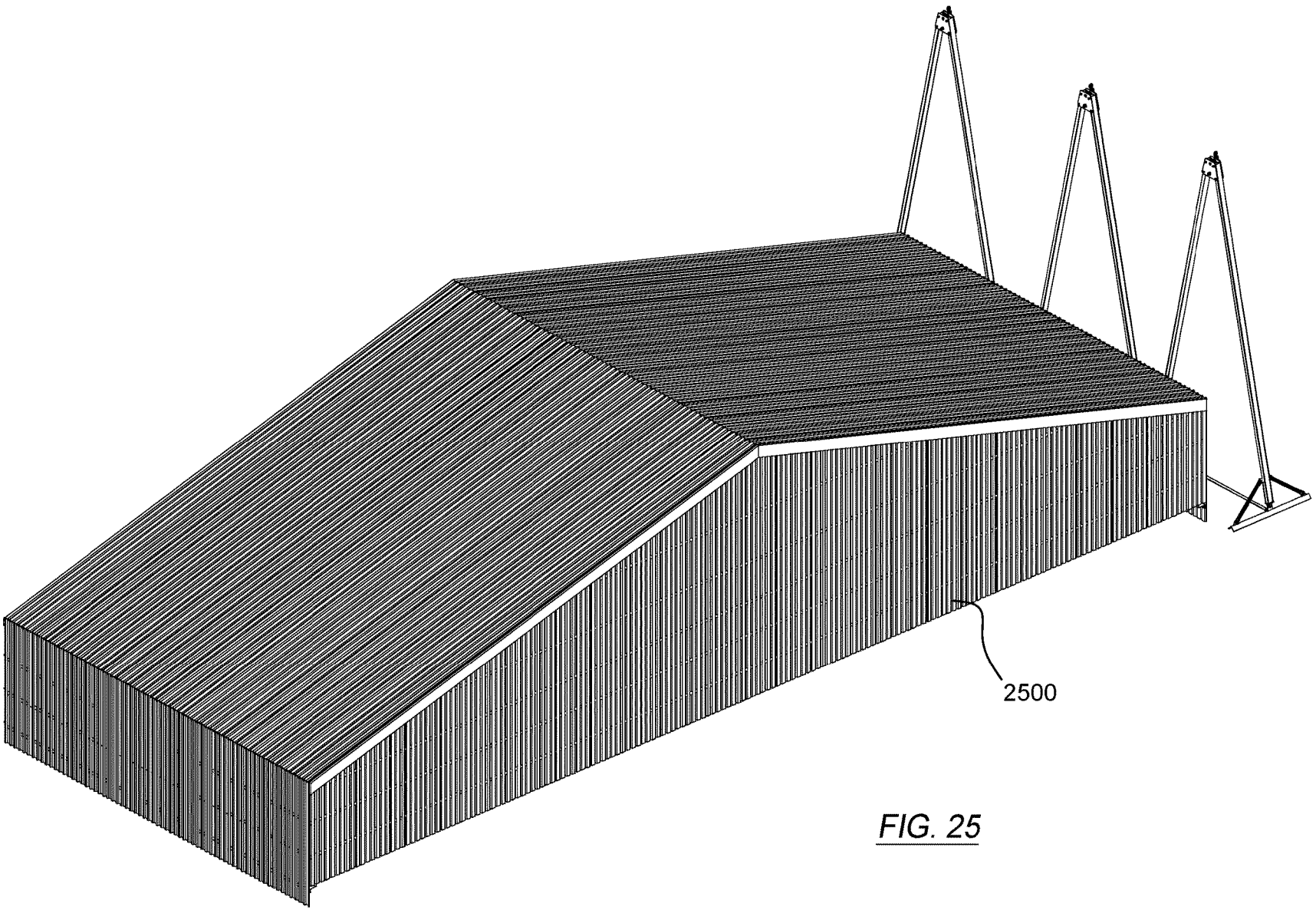

Referring now to FIG. 25, additional siding may be added to the building. Thus, for example, siding (2500) may be added to the side of the building. The siding (2500) may be connected to attachment points of the additional columns (2404), such as those shown in FIG. 24.

Figure 26:
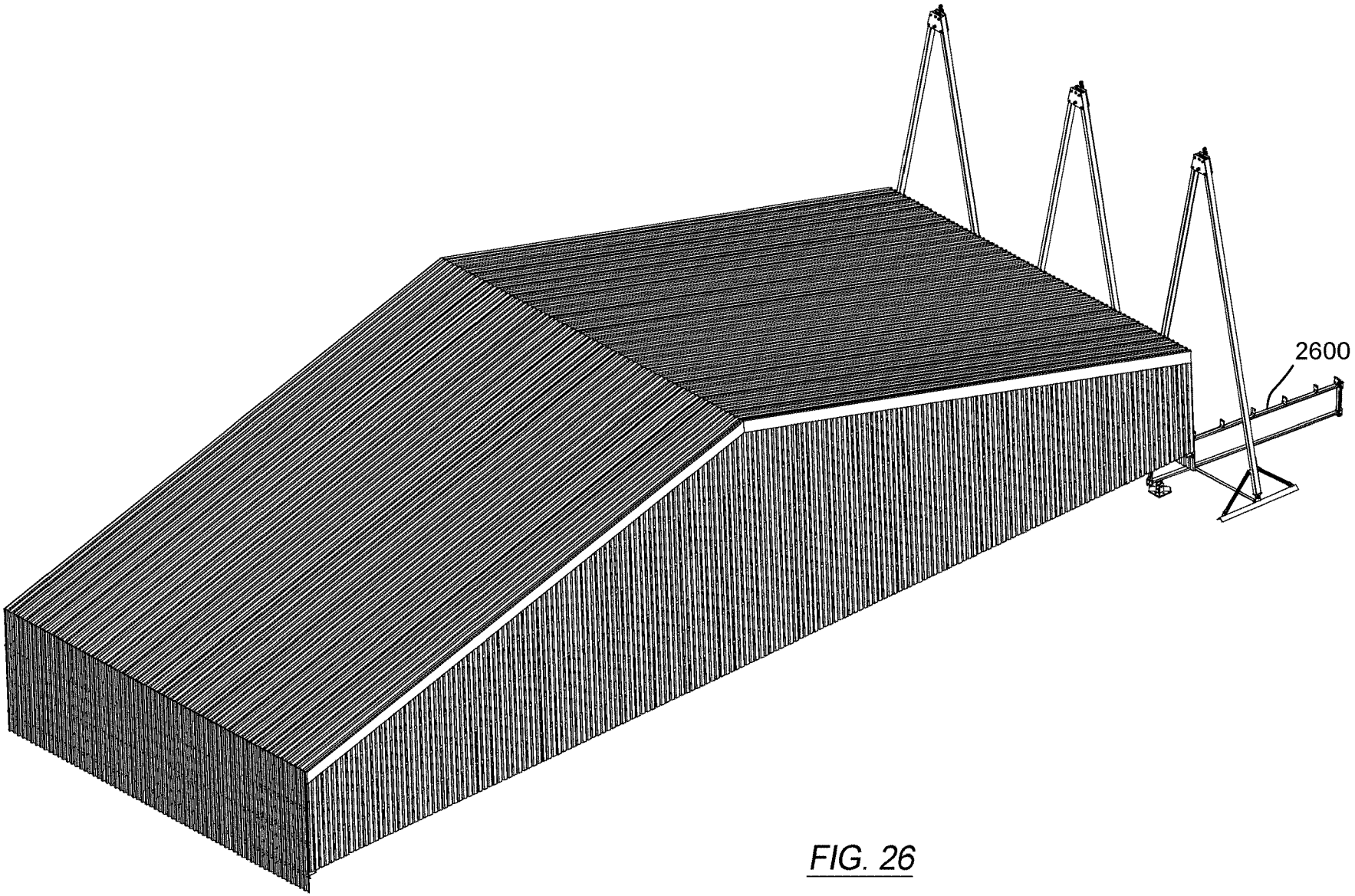

Referring to FIG. 26, in an embodiment, the building may be taller than the building formed after the stage shown in FIG. 25. Thus, for example, additional support beams may be added to the column support beams shown in FIG. 23. For example, the A-frame lifters may be used to lift the building by a pre-determined distance. The pre-determined distance is sufficient to add additional support beams, such as support beam (2600). The support beams, including support beam (2600), may be added in an orientation that will add to the overall length of the wall of the building once the corresponding support beams have been rotated so that their respective clevis components are in interlocking relationship.

Figure 27:
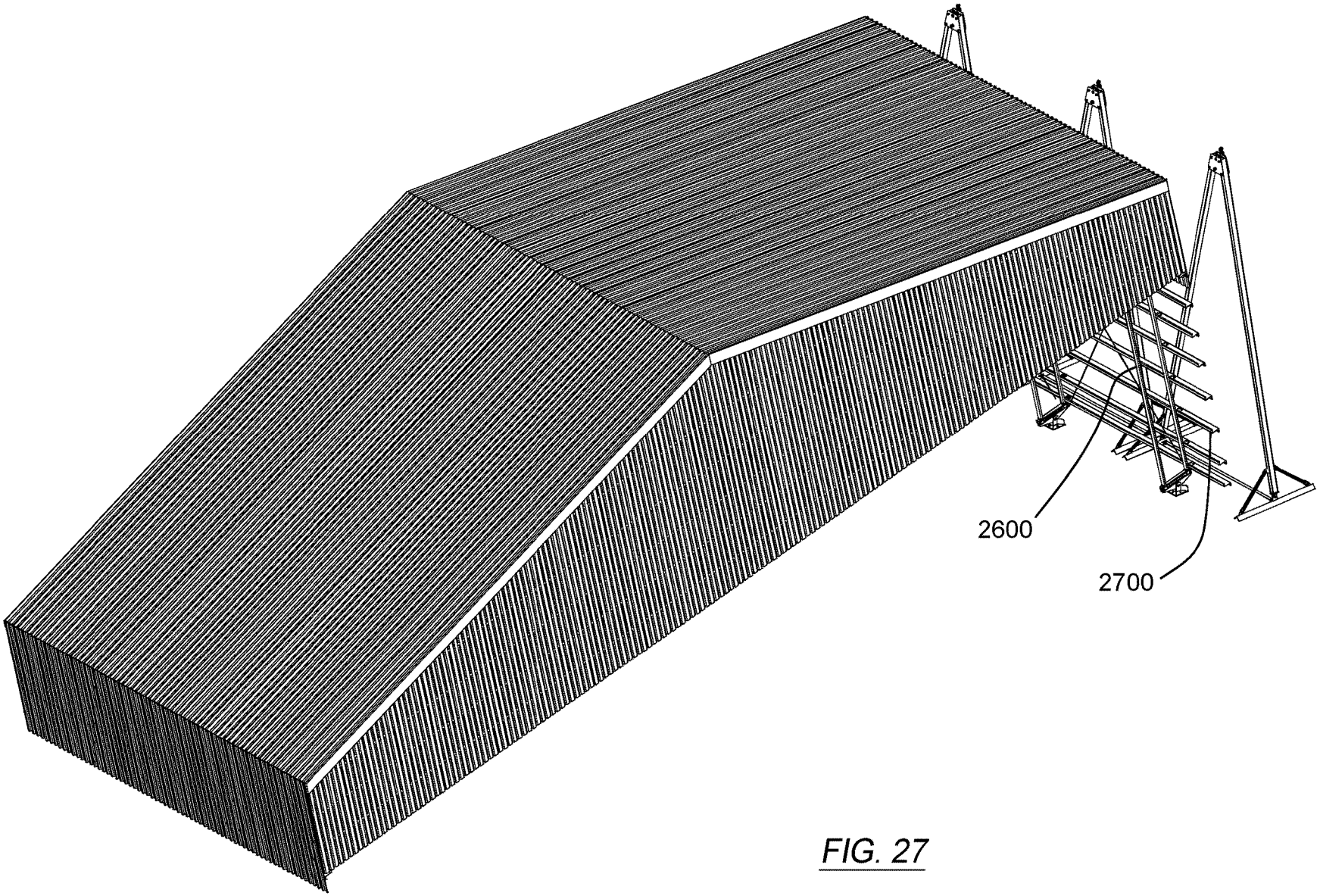

Referring to FIG. 27, the A-frame lifters lift the building at or above the joints between the respective support beams that are being rotated until their respective clevis components come into full interlocking relationship. Thus, in this example, the support beam (2600) added in FIG. 26 now forms a straight line with the support beam (2300) (not shown in FIG. 26, see FIG. 23). The clevis components are then locked, as described above. Optionally, additional cross beams, such as cross beam (2700), may be added.

Figure 28:
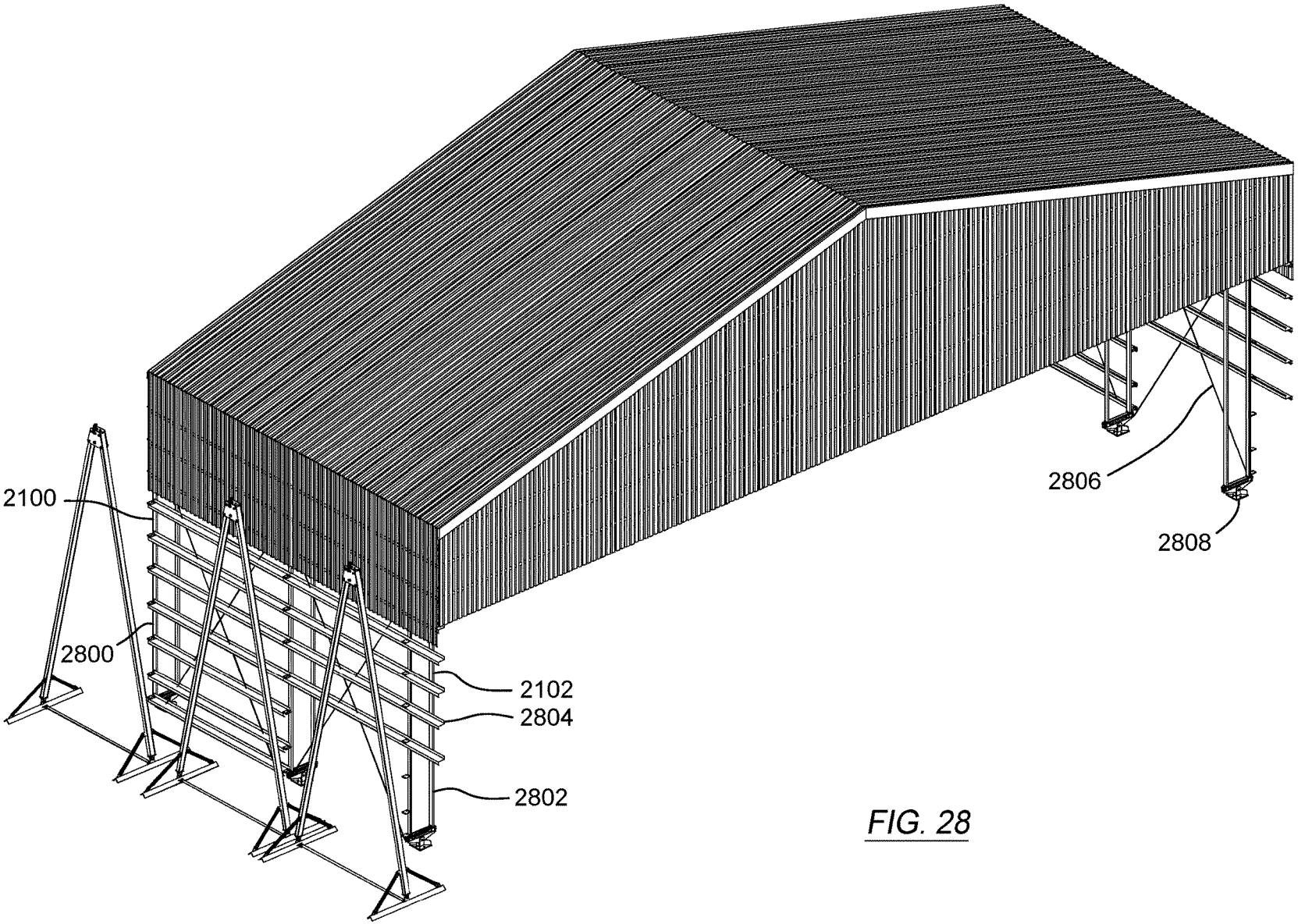

Referring to FIG. 28, the same procedure described with respect to FIG. 27 is now performed on the opposite side of the frame elements. Thus, the A-frame lifters are moved to the other side of the frame elements of the building. Additional support beams, such as support beam (2800) through support beam (2802), are connected to the corresponding support beams, such as support beam (2100) through support beam (2102). Again, the additional support beams (2800 and 2802) are rotated until their corresponding clevis components come into full interlocking relationship with each other, and then the corresponding clevis components are locked.

In addition, assuming the building has reached the full desired height, the additional support beams added to the columns of the building may be connected to the anchors, such as anchor (2808). Thus, for example, after lifting, a clevis component fixed to the anchor may come into full interlocking relationship with a clevis component on the final support beam that forms a column of the building. The clevis components between the anchor and final support beams are then fixed. This relationship is shown in FIG. 5.

Optionally, more cross beams, such as cross beam (2804) may be added. If desirable, additional crisscross beams, such as crisscross beam (2806), may be connected to the support beams or cross beams. The crisscross beams may provide additional structural reinforcement for the walls of the building.

Figure 29:
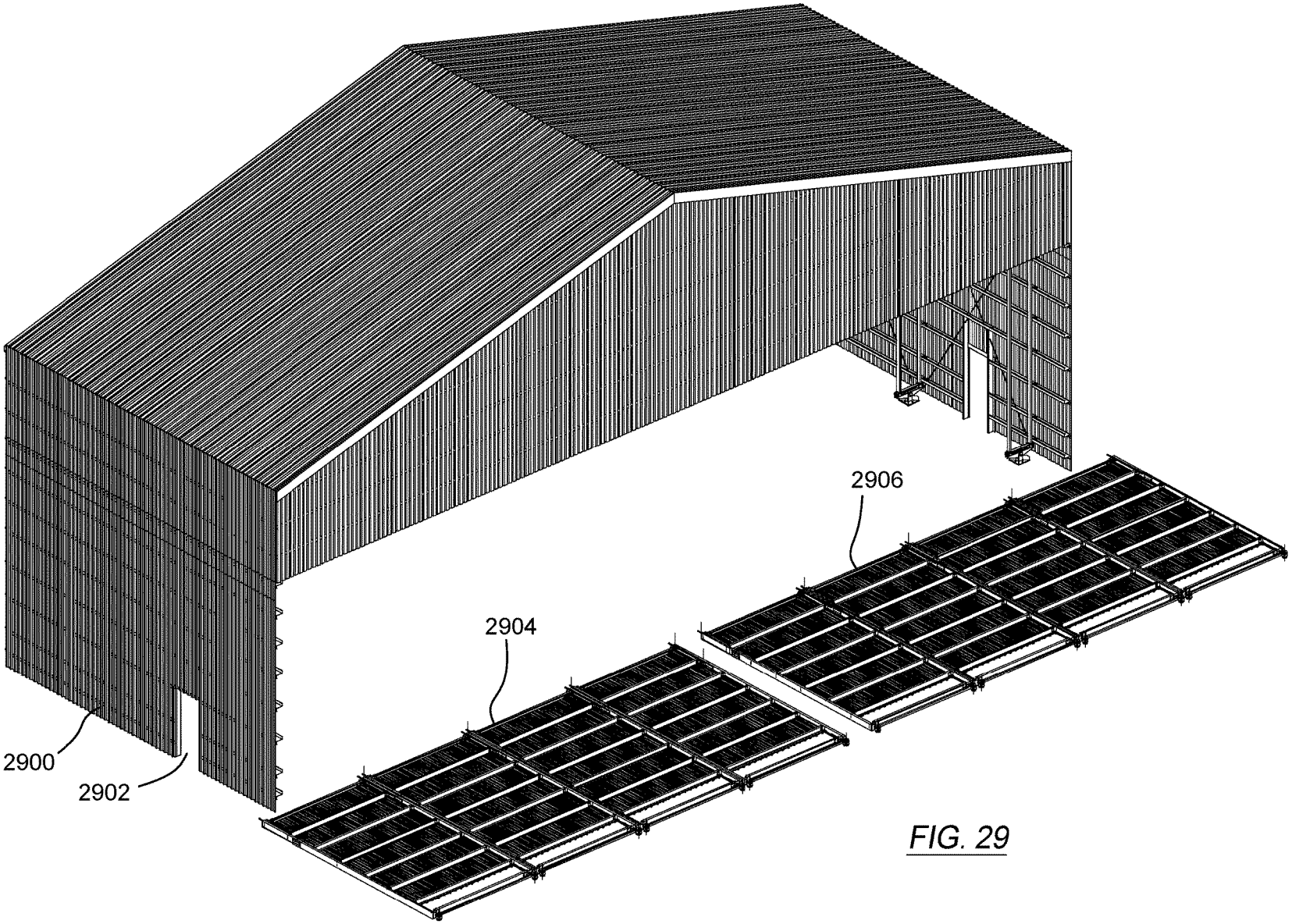
Figure 30:
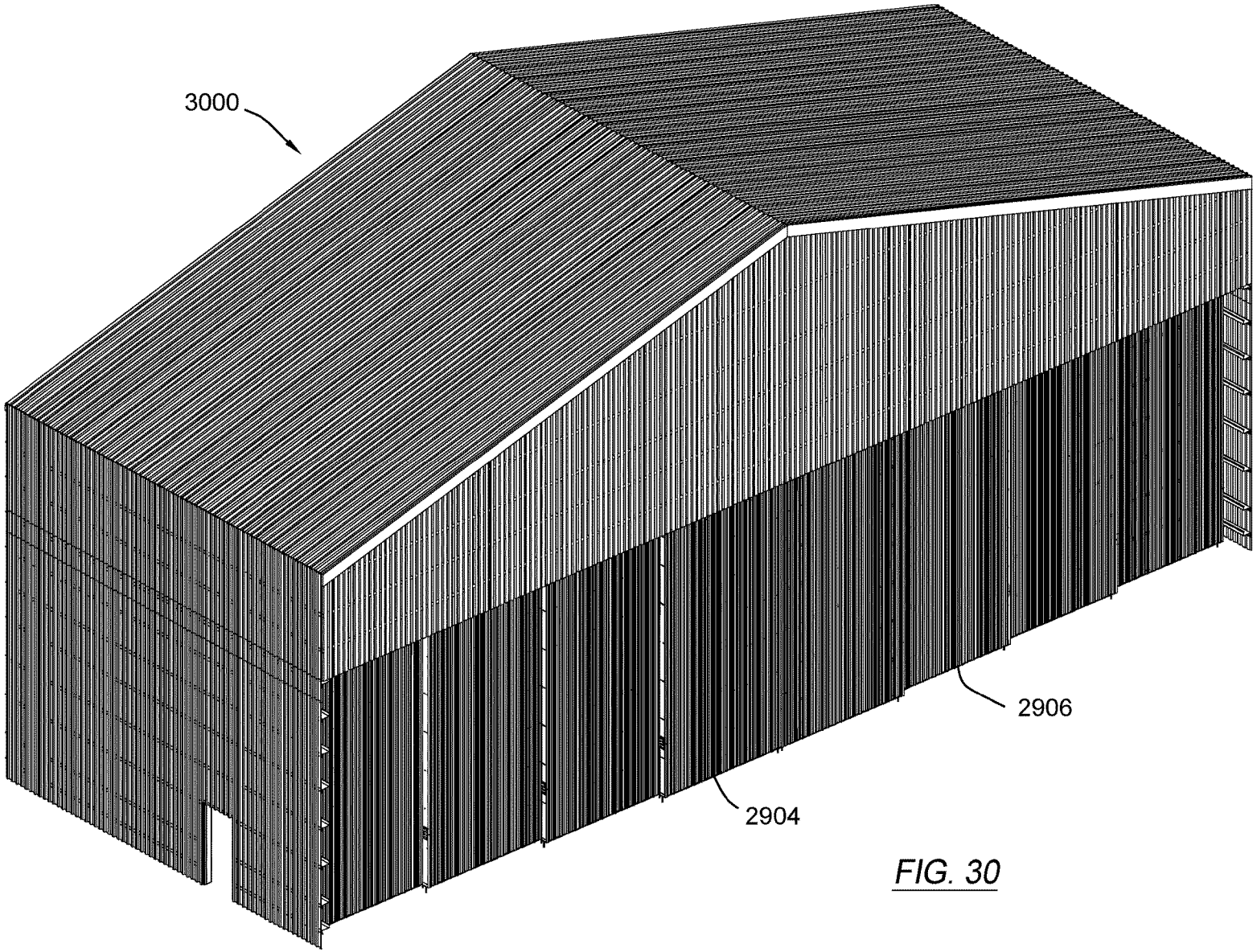

Referring to FIG. 29, additional siding, such as siding (2900) is connected to the walls cross beams to form the walls of the building. One or more openings, such as opening (2902), may be cut out of the siding, or provided as part of the siding, in order to accommodate a door through which a human, animal, or equipment may move. Two telescoping doors, including telescoping door (2904) and telescoping door (2906) may be laid out before securing the doors to the rest of the building. A telescoping door is formed from multiple panels that slide with respect to each other as the doors are opened or closed. Other doors or walls could be attached, instead.

Referring to FIG. 30, the erected building (3000) is shown. In this example, the telescoping door (2904) and telescoping door (2906) are shown closed. In this example, the erected building (3000) is suitable for use as an aircraft hangar. However, the building could be used for many different purposes.

Many variations exist relative to the procedures shown in FIG. 10 through FIG. 30. For example, in FIG. 10 through FIG. 30, sometimes support beams were lifted before additional support beams were added. However, in an embodiment, it is possible in some cases to lay out all support beams in a line, and then raise the support beams in stages. In another embodiment, buildings of more complex shape may be erected using the same arrangement and procedures of support beams, clevis components, connectors, lifting, and locking. Buildings of more complex shape could be built using support beams of different shape, by varying the angles at which beams lock with each other, etc. Different types of lifters could be used to lift the support beams during the lifting and locking process described above. Additionally, more or fewer support beams could be present, or different types of siding could be used. Pipes, chimneys, and other kinds of fixtures could be added. Thus, many different variations are possible.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method, comprising:

placing a first plurality of beams end to end on a surface, wherein each beam in the first plurality of beams is connectable to at least one other beam in the first plurality of beams via a first plurality of first pairs of clevis components disposed on ends of the first plurality of beams;

connecting, for all of the first plurality of first pairs of clevis components, one clevis component of a first beam to another opposing clevis component of a second beam;

placing a second plurality of beams end to end on the surface, wherein each beam in the second plurality of beams is connectable to at least one other beam in the second plurality of beams via a second plurality of second pairs of clevis components disposed on ends of the second plurality of beams, and wherein the second plurality of beams are spaced apart from the first plurality of beams;

connecting, for all of the second plurality of second pairs of clevis components, one clevis component of one beam to an opposing clevis component of another beam;

placing a first A-frame over a first interconnected pair of clevis components in the first plurality of beams, wherein the first A-frame further comprises a first lifting mechanism;

placing a second A-frame over a second interconnected pair of clevis components in the second plurality of beams, wherein the second A-frame further comprises a second lifting mechanism;

connecting the first lifting mechanism to at least one of the first interconnected pair of clevis components in the first plurality of beams;

connecting the second lifting mechanism to at least one of the second interconnected pair of clevis components in the second plurality of beams;

lifting, simultaneously, the first lifting mechanism and the second lifting mechanism until two beams in the first plurality of beams completely interlock clevis components and another two beams in the second plurality of beams completely interlock clevis components;

connecting third interconnected clevis components opposing the first interconnected pair of clevis components and connecting fourth interconnected clevis components opposing the second interconnected pair of clevis components.

2. The method of claim 1, further comprising:

moving, after connecting the clevis components not already connected, the first A-frame over a fifth interconnected pair of clevis components in the first plurality of beams;

moving, after connecting the clevis components not already connected, the second A-frame over a sixth interconnected pair of clevis components in the second plurality of beams;

lifting, simultaneously, the first lifting mechanism and the second lifting mechanism until another, separate two beams in the first plurality of beams completely interlock clevis components and another, different two beams in the second plurality of beams completely interlock clevis components;

connecting seventh interconnected clevis components opposing the fifth interconnected pair of clevis components and connecting eighth interconnected clevis components opposing the sixth interconnected pair of clevis components.

3. The method of claim 1, wherein the first plurality of beams further comprises a first end beam comprising a first footer and a second end beam comprising a second footer, wherein the second plurality of beams further comprises a third end beam comprising a third footer and a fourth end beam comprising a fourth footer, and wherein the method further comprises:

attaching the first footer to a first anchor anchored to the surface;

attaching the second footer to a second anchor anchored to the surface;

attaching the third footer to a third anchor anchored to the surface; and attaching the fourth footer to a fourth anchor anchored to the surface.

4. The method of claim 3 wherein each of the first footer, the second footer, the third footer, and the fourth footer attach at corresponding pluralities of attachment points.

5. The method of claim 1, further comprising:

connecting a cross-beam to at least one of the first plurality of beams and to at least one of the second plurality of beams.

6. The method of claim 5, further comprising:

attaching siding to the cross-beam to form a covered building.

7. The method of claim 6, further comprising:

attaching at least one of a door and a window to the covered building.

8. A method, comprising:

placing a first plurality of beams end to end on a surface, wherein each beam in the first plurality of beams is connectable to at least one other beam in the first plurality of beams via a first plurality of first pairs of clevis components disposed on ends of the first plurality of beams;

connecting, for all of the first plurality of first pairs of clevis components, one clevis component of a first beam to another opposing clevis component of a second beam;

placing a second plurality of beams end to end on the surface, wherein each beam in the second plurality of beams is connectable to at least one other beam in the second plurality of beams via a second plurality of second pairs of clevis components disposed on ends of the second plurality of beams, and wherein the second plurality of beams are spaced apart from the first plurality of beams;

connecting, for all of the second plurality of second pairs of clevis components, one clevis component of one beam to an opposing clevis component of another beam;

placing a first lifter over a first interconnected pair of clevis components in the first plurality of beams, wherein the first lifter further comprises a first lifting mechanism;

placing a second lifter over a second interconnected pair of clevis components in the second plurality of beams, wherein the second lifter further comprises a second lifting mechanism;

connecting the first lifting mechanism to at least one of the first interconnected pair of clevis components in the first plurality of beams;

connecting the second lifting mechanism to at least one of the second interconnected pair of clevis components in the second plurality of beams;

lifting, simultaneously, the first lifting mechanism and the second lifting mechanism until two beams in the first plurality of beams completely interlock clevis components and another two beams in the second plurality of beams completely interlock clevis components;

connecting third interconnected clevis components opposing the first interconnected pair of clevis components and connecting fourth interconnected clevis components opposing the second interconnected pair of clevis components.

9. The method of claim 8, further comprising:

moving, after connecting the clevis components not already connected, the first lifter over a fifth interconnected pair of clevis components in the first plurality of beams;

moving, after connecting the clevis components not already connected, the second lifter over a sixth interconnected pair of clevis components in the second plurality of beams;

lifting, simultaneously, the first lifting mechanism and the second lifting mechanism until another, separate two beams in the first plurality of beams completely interlock clevis components and another, different two beams in the second plurality of beams completely interlock clevis components;

connecting seventh interconnected clevis components opposing the fifth interconnected pair of clevis components and connecting eighth interconnected clevis components opposing the sixth interconnected pair of clevis components.

10. The method of claim 8, wherein the first plurality of beams further comprises a first end beam comprising a first footer and a second end beam comprising a second footer, wherein the second plurality of beams further comprises a third end beam comprising a third footer and a fourth end beam comprising a fourth footer, and wherein the method further comprises:

attaching the first footer to a first anchor anchored to the surface;

attaching the second footer to a second anchor anchored to the surface;

attaching the third footer to a third anchor anchored to the surface; and attaching the fourth footer to a fourth anchor anchored to the surface.

11. The method of claim 10 wherein each of the first footer, the second footer, the third footer, and the fourth footer attach at corresponding pluralities of attachment points.

12. The method of claim 8, further comprising:

connecting a cross-beam to at least one of the first plurality of beams and to at least one of the second plurality of beams.

13. The method of claim 12, further comprising:

attaching siding to the cross-beam to form a covered building.

14. The method of claim 13, further comprising:

attaching at least one of a door and a window to the covered building.

* * * * *